US006966113B2

(12) United States Patent
Fossella

(10) Patent No.: US 6,966,113 B2
(45) Date of Patent: Nov. 22, 2005

(54) UTILITY KNIFE

(75) Inventor: Gregory Fossella, Scituate, MA (US)

(73) Assignee: Repetto LLC, Scituate, MA (US)

( * ) Notice: Subject to any disclaimer, the term of this patent is extended or adjusted under 35 U.S.C. 154(b) by 0 days.

(21) Appl. No.: 10/122,787

(22) Filed: Apr. 15, 2002

(65) Prior Publication Data

US 2004/0040159 A1 Mar. 4, 2004

Related U.S. Application Data

(60) Provisional application No. 60/307,285, filed on Jul. 23, 2001.

(51) Int. Cl.[7] ..... B26B 1/08
(52) U.S. Cl. ..... 30/162; 30/335
(58) Field of Search ..... 30/162, 124, 125, 30/335, 336

(56) References Cited

U.S. PATENT DOCUMENTS

| | | | | |
|---|---|---|---|---|
| 3,577,637 A | | 5/1971 | Braginetz | |
| 3,660,896 A | * | 5/1972 | Umholtz | 30/162 |
| 3,708,881 A | | 1/1973 | Bennett | |
| 4,005,525 A | | 2/1977 | Gringer | |
| 4,277,888 A | | 7/1981 | Szabo | |
| 4,517,741 A | | 5/1985 | Castelluzzo | |
| 4,761,882 A | | 8/1988 | Silverstein | |
| 5,404,645 A | * | 4/1995 | Janser | 30/125 |
| 5,426,855 A | | 6/1995 | Keklak et al. | |
| 5,435,062 A | * | 7/1995 | Huang | 30/125 |
| 5,604,984 A | | 2/1997 | Shepherd et al. | |
| 5,727,320 A | | 3/1998 | Shepherd et al. | |
| 5,890,294 A | | 4/1999 | Keklak et al. | |
| 5,909,930 A | | 6/1999 | Ragland, III et al. | |
| 5,960,544 A | * | 10/1999 | Beyers | 30/125 |
| 5,960,545 A | * | 10/1999 | Shepherd et al. | 30/125 |
| 6,148,522 A | * | 11/2000 | Dobandi | 30/162 |
| 6,327,780 B1 | * | 12/2001 | Bigham et al. | 30/162 |
| 6,374,497 B1 | * | 4/2002 | Sun | 30/162 |
| 6,415,514 B1 | * | 7/2002 | Chun | 30/162 |
| 6,487,778 B1 | * | 12/2002 | Gringer et al. | 30/162 |
| 6,513,246 B2 | * | 2/2003 | Ping | 30/125 |
| 6,829,827 B2 | * | 12/2004 | Tseng | 30/162 |
| 6,848,185 B2 | * | 2/2005 | Tebo | 30/162 |
| 2004/0000055 A1 | * | 1/2004 | Lee | 30/125 |

FOREIGN PATENT DOCUMENTS

WO WO US02/20558 6/2003

* cited by examiner

*Primary Examiner*—Allan N. Shoap
*Assistant Examiner*—Jason Prone
(74) *Attorney, Agent, or Firm*—Wolf, Greenfield & Sacks PC

(57) ABSTRACT

A utility knife has a disposable blade cartridge in its handle that has front and rear blade compartments. Each compartment is sized to store a plurality of blades in side-by-side relation. Fresh blades are disposed in the front compartment and one end of each is advanced one at a time substantially out of the compartment into operative position by a carrier that is controlled by an actuator on the handle. When the active blade is to be replaced, it is moved by the carrier into the rear compartment, and a new blade may then be withdrawn from the front compartment into the operative position. The active blade when not in use is partially withdrawn into the front compartment. The cartridge is reversed when the one end of all the blades in the front compartment are used, placing what was the rear compartment at the front, and the unused end of each blade is advanced into the operative position and when used they are each moved to the rear compartment. When all are used, a new cartridge replaces the old in the knife

47 Claims, 16 Drawing Sheets

UTILITY KNIFE

FIELD OF THE INVENTION

This invention relates to utility knives and more particularly comprises a utility knife with an automatic blade loading system that enables the user to change blades without touching them so as to achieve maximum safety, speed and convenience in the operation of the device. This application claims the benefits of applicant's earlier filed, copending provisional application Ser. No. 60/307,285 filed Jul. 23, 2001 and incorporated herein by reference.

BACKGROUND OF THE INVENTION

Utility knives are widely used for a number of different purposes and are a very popular and handy tool. Conventionally, utility knives use a thin double-ended blade that in use extends out one end of the knife case. When the cutting end becomes dull or otherwise unsuited for continued use, the blade is reversed so that its other end extends out of the case. In most utility knives, reversal of the blade requires handling of it, and because the blades are very sharp, thin, and not particularly easy to handle, accidents frequently occur. It is also difficult to properly mount the blade within the components in the case.

A number of utility knives have been developed that employ cartridges that hold a plurality of blades, some of which enable the user to change the blade with a reduced risk of cutting ones self, but none have proved to be entirely satisfactory. Some require a very large case to receive the cartridge, which detracts from the comfort of using the tool. And none of the prior art tools known to applicant provide total protection against accidental injury when reversing or changing the blade. Many of those knives have non-traditional shapes so as to limit their appeal to those who frequently use them.

SUMMARY OF THE INVENTION

In accordance with the present invention, the utility knife has a cartridge that may contain as many as 20 or more blades fully enclosed in it and that may be mounted in the case without the user coming into contact with any of the blades. In accordance with one embodiment of the invention, the cartridge is initially packaged with all the blades in one compartment stacked close together, side-by-side. The blades may be extended from the cartridge and the case, one at a time to an operative position wherein one end of the blade is exposed, and when not in use the blade may be fully withdrawn into the case. An actuator mounted on the case controls a carrier that engages the blades in the cartridge one at a time and slides them to the operative position wherein one end of the blade extends from the case as well as to a number of retracted positions within the case.

In accordance with another aspect of the present invention, the cartridge has two compartments, one of which when the cartridge is initially loaded, contains all of the blades, and the other compartment is empty. After one end of each blade has been used and is to be replaced, the used blade is moved into the second compartment and thereafter, the next blade in the first compartment is moved into position for continued use of the knife. This sequence is followed for each of the blades in the first compartment until one end of each blade is used and all are deposited in the second compartment. Thereafter, the cartridge is repositioned in the case so that the second compartment is close to the operative end of the case and all of the blades may be withdrawn in sequence from the second compartment. When the cartridge is repositioned in the case, the blades in the second compartment are positioned so that the unused ends of the blades are moved one at a time into the operative position. In sequence, each of the blades in the second compartment is extended to the operative position exposing the unused end and when the second end is worn, the blade is deposited in the first compartment now at the rear of the case. When both ends of all the blades are used, the cartridge is discarded and a new one inserted in the case.

In accordance with another aspect of the present invention, the carrier which moves through the cartridge and case to position the blades one at a time in the operative position and alternate retracted positions, is operated by an actuator that remains locked in position until the actuator lock is released to allow the actuator to move longitudinally in the case. As the actuator is attached to the carrier, the carrier cannot move without movement of the actuator, and only the actuator is accessible to move the carrier and the blades.

The various aspects of the present invention will be better understood and appreciated from the following detailed description of one embodiment thereof shown in the accompanying drawings, in which:

DETAILED DESCRIPTION

Figure 1:
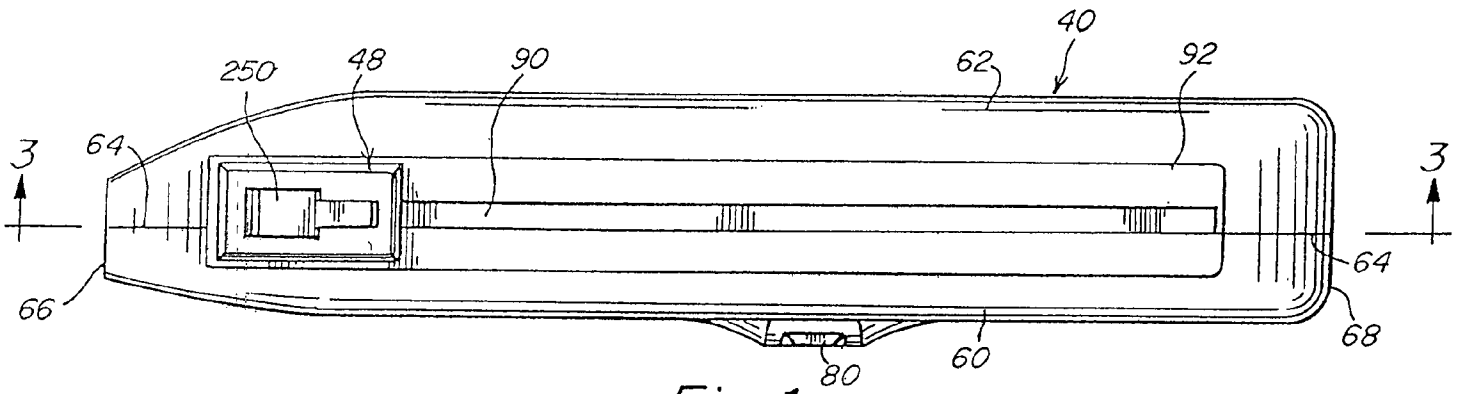
FIG. 1 is a top plan view of a utility knife in accordance with one embodiment of the invention.

The utility knife of the present invention includes a case 40, a blade cartridge 42 containing a number of blades 44, a carrier 46 movable within the case 40 and through the cartridge 42, and an actuator 48 connected to the carrier and accessibly mounted on the case 40. As is described in detail below, the cartridge in a preferred embodiment of the invention contains a pair of compartments and is initially filled with all of the new blades in the same compartment, while the other compartment is empty. The blades are withdrawn from the new blade compartment one at a time so that one end of each blade may be sequentially used, and after each blade requires replacement, it is deposited in the other compartment. When all of the blades have been transferred to the other compartment, the cartridge is reversed in the case and the unused edges of the blades are sequentially used and then deposited in what becomes the used blade compartment when the cartridge is reversed. In this manner, one edge of each blade is used as the active cutting implement in the utility knife, and when all the blades have one used edge, the cartridge is reversed so as to place the unused edges in position to be used in sequence. These various components are described separately below along with their interaction with the other components in the assembly.

Case 40

The case 40 is particularly illustrated in FIGS. 1–8. The case in the illustrated embodiment typically is a metal casting such as die casting of aluminum or zinc and is composed of two halves or shells 60 and 62 that may be secured together by any one or more of a variety of different fasteners such as screws, hook-like fingers, snaps, etc. to form an elongated housing for the utility knife components as well as a handle for operating the knife. In FIGS. 1 and 5–7, parting lines 64 along the top and bottom are suggested representing the mating edges of the two halves 60 and 62 of the case. In this description the end 66 of the case will sometimes be identified as the front end while the other end 68 will sometimes be identified as the back end of the case. The parting line 64 of the case runs longitudinally from end-to-end, and in the usual orientation of the case illustrated, is in a vertical plane. The front end of the case 66 has a blade slot 70 (see FIG. 4) through which individual blades may be extended to an operative position by the carrier 46 and through which the blade may be withdrawn into the case and into the cartridge 42 when not in use. It should be understood that while the case in the illustrated embodiment is composed of two half shells split longitudinally along the approximate center line of the case, the case may be made up of a different number of parts and the various components may be assembled in a variety of different ways.

Figure 2:
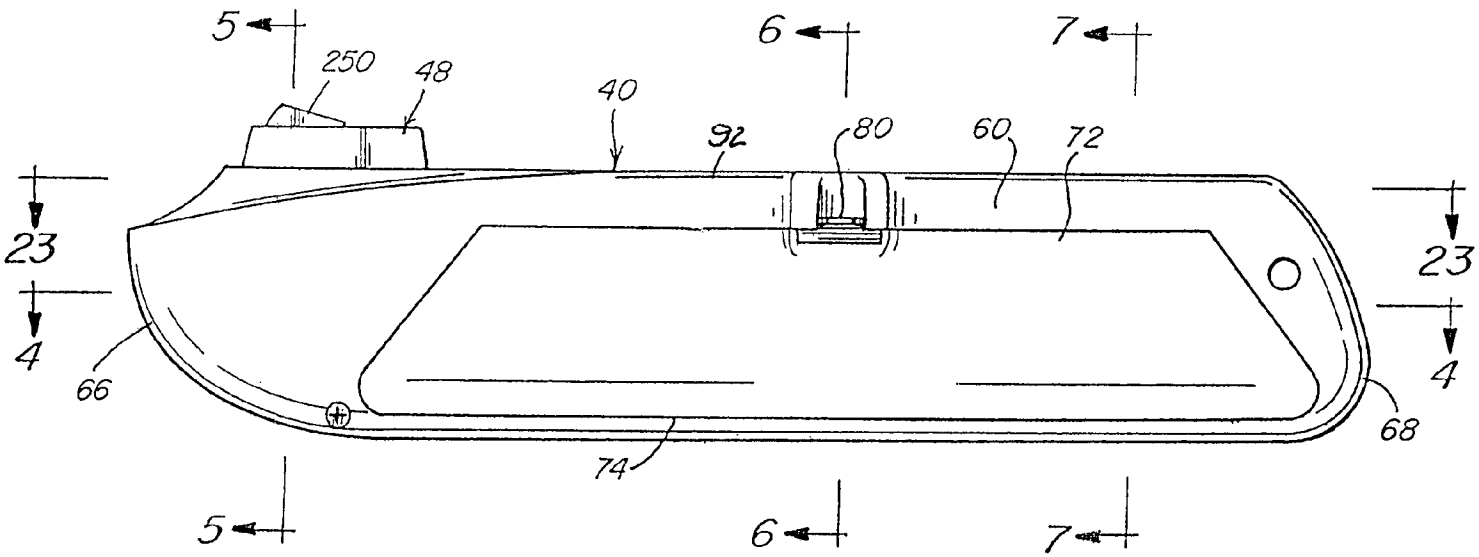
FIG. 2 is a side elevation view of the utility knife shown in FIG. 1.
Figure 3:
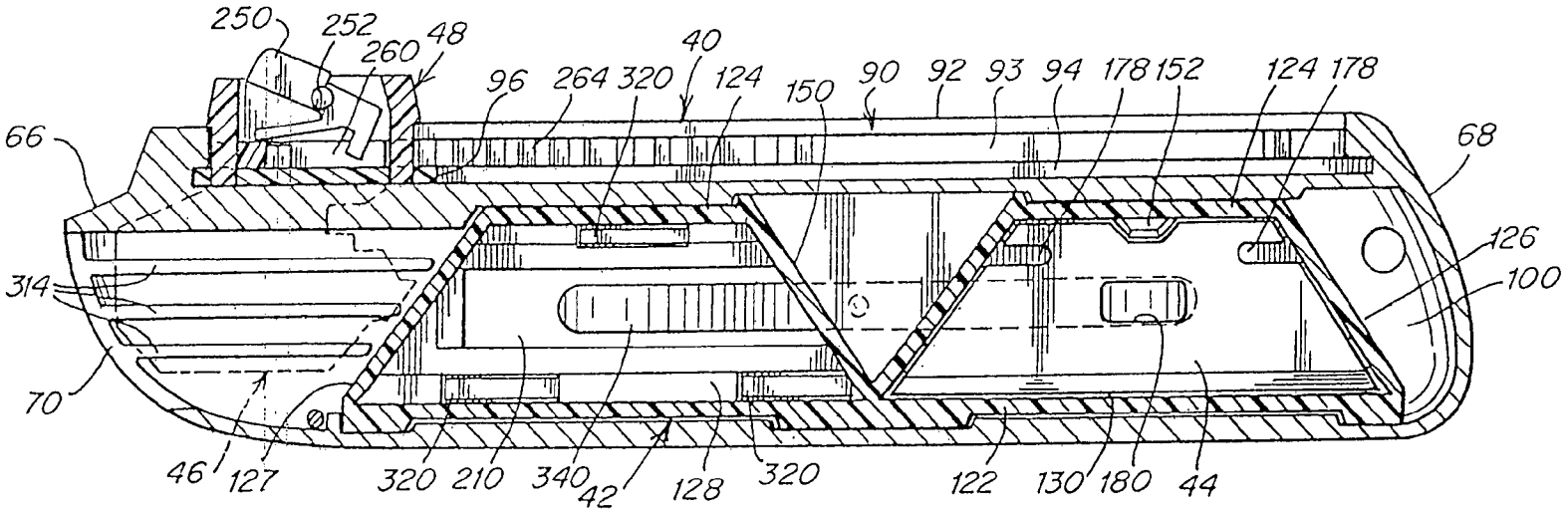
FIG. 3 is a vertical cross-sectional view of the knife taken along section line 3—3 in FIG. 1.
Figure 4:
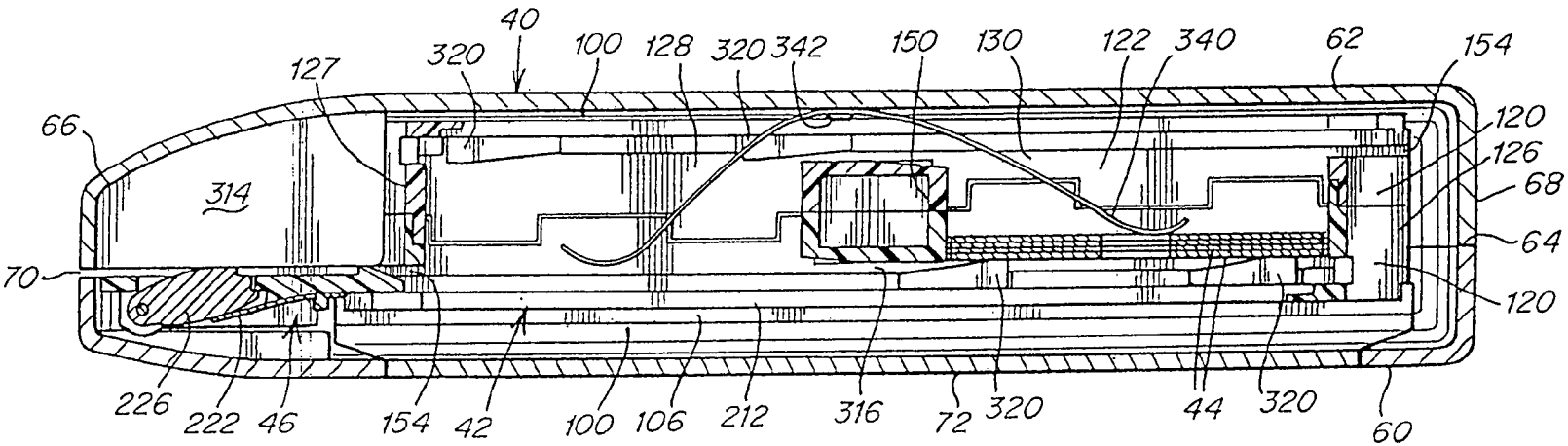
FIG. 4 is a horizontal cross-sectional view of the knife taken along section line 4—4 in FIG. 2.
Figure 5:
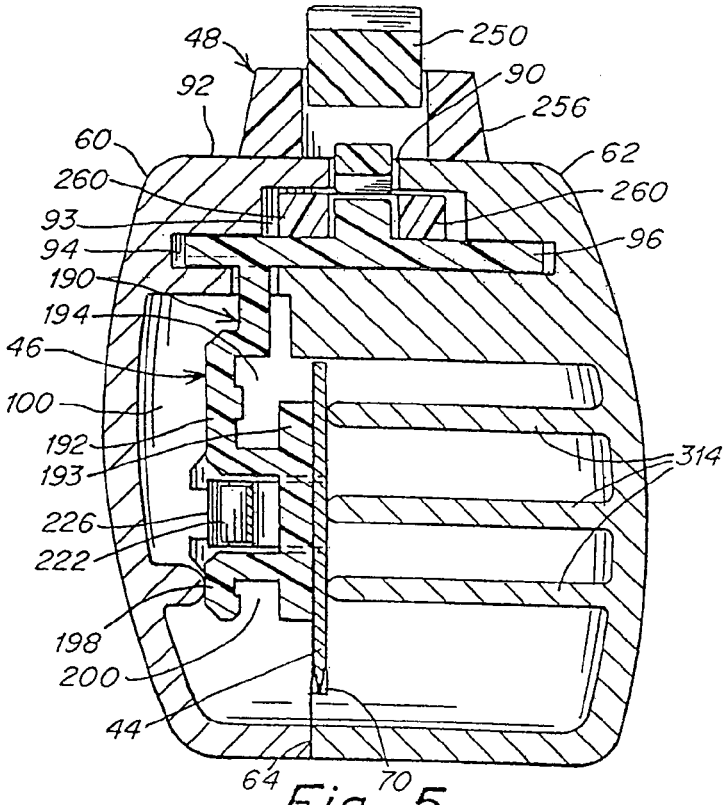
FIGS. 5, 6 and 7 are cross-sectional views of the knife taken along the corresponding section lines in FIG. 2, respectively.
Figure 6:
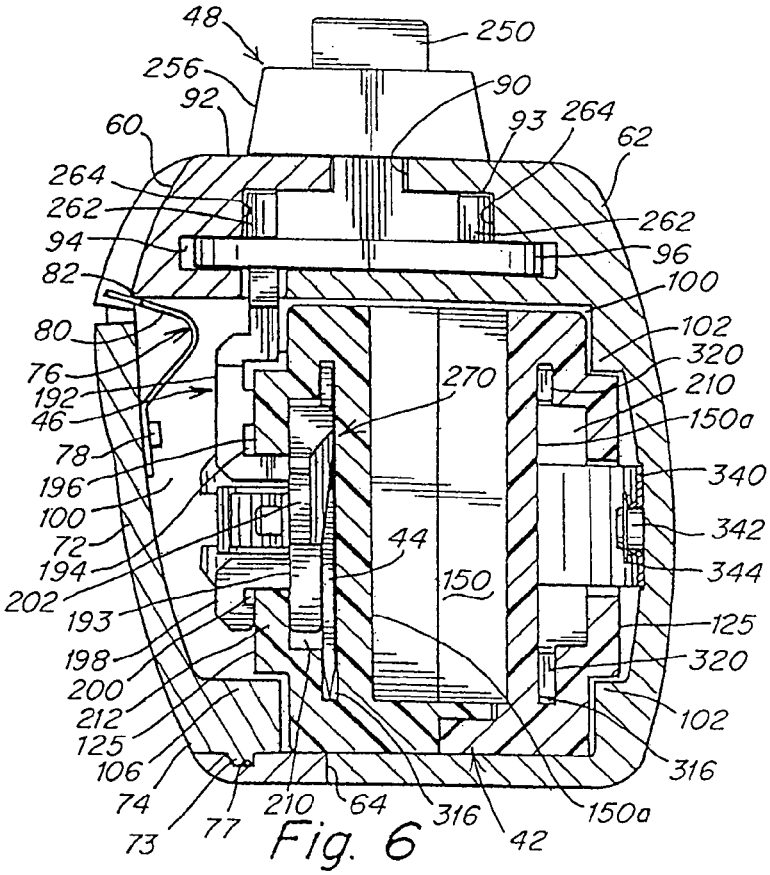
Figure 7:
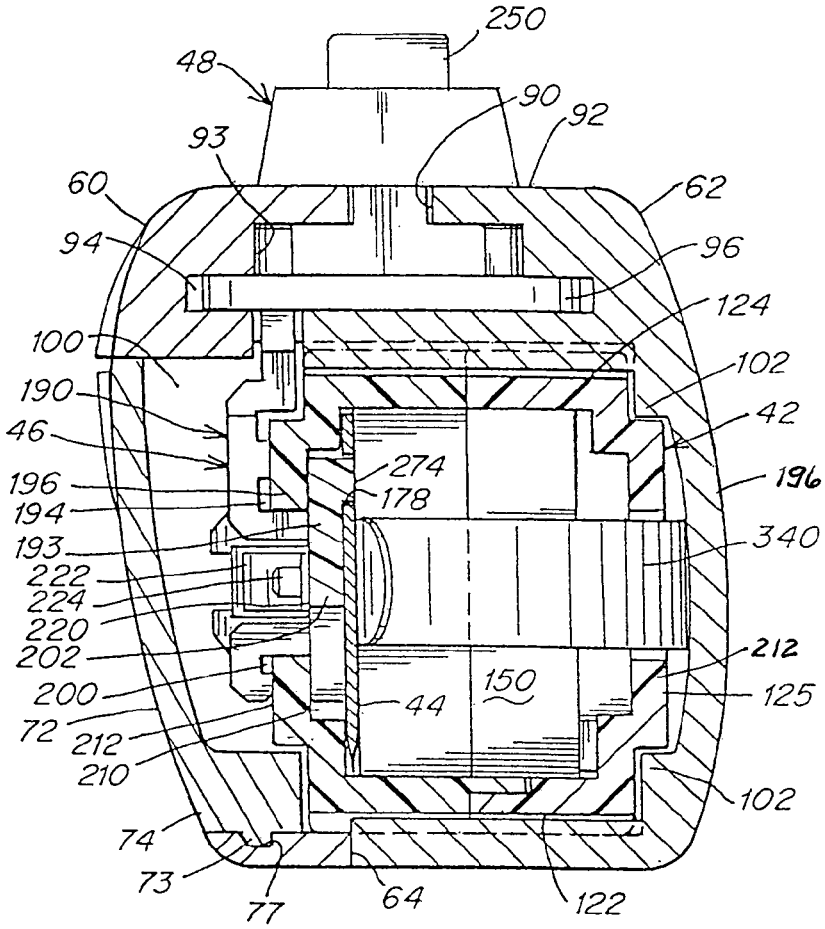

As shown in FIGS. 2, 6 and 7, the case shell 60 includes a door 72 through which access is gained to its interior chamber 100. The door may be mounted on the case shell 60 by many different ways. For example, the bottom 74 of the door may be provided with prongs 73 that are received in recesses 77 in the bottom of the shell 60 as shown in FIGS. 6 and 7 to secure the bottom of the door in place. The top of the door may be held in place by a latch 76 at the top of the door that releasably engages the edge of the door opening in the shell 60. One embodiment of a latch is suggested in FIGS. 6 and 8. The latch 76 is shown in the form of a spring mounted on a post 78 on the inside of the door 72, and having a free arm 80 that engages the edge 82 of the door opening in shell 60. Many other and different types of closures may be employed, but they should not interfere with the grasping of the case as a handle when the knife is being used and should not accidentally or inadvertently open particularly during use. The door may be removable or not, but must at least open sufficiently wide so as to enable the cartridge 42 to be conveniently and easily inserted into and removed from the case interior chamber 100. The door as one alternative may be hinged to the case, and any form of latch may be used in combination with the hinge for releasably holding the door closed. Many other arrangements for holding the door in place may be used as well.

Figure 8:
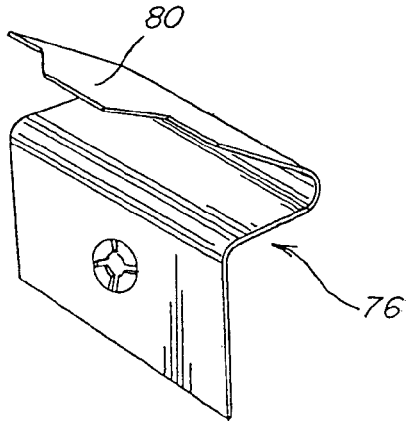
FIG. 8 is a perspective view of a spring that in accordance with an embodiment of the invention serves as a latch for the door in the case through which the cartridges are inserted and removed from the case.
Figure 9:
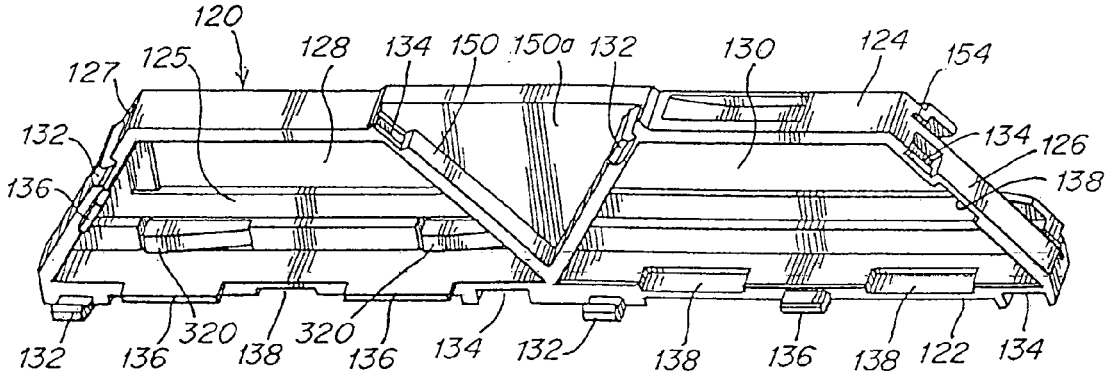
FIG. 9 is a perspective view of one half of the blade cartridge, the full cartridge being made up of two identical halves, in accordance with another aspect of this invention.

A slot 90 (see FIG. 1) is provided in the top 92 of the case and extends longitudinally a substantial portion of the case length and serves as a slide track for the actuator 48. As shown in FIGS. 6–8, the slot 90 opens into a chamber 93 below which is a channel 94 that receives the shoulders of panel 96 of the carrier 46.

The case 40 and more particularly its shells 60 and 62 define the large chamber 100 that receives the cartridge 42 and carrier 46. The shell 62 is provided with shoulders 102 on its inner surface (see FIGS. 6 and 7) that conform to the shape of the cartridge 42 so as to provide a firm seat for it. The bottom 74 of the door also has a shoulder 106 that provides further support for the cartridge 42 when the cartridge is in place in the chamber 100.

Cartridge 42

The cartridge 42 is shown in FIGS. 9–12. The cartridge 42 in accordance with this embodiment is made up of two identical halves 120 that may be injection molded of a plastic material such as nylon or be made of any other suitable material. Each half has a bottom wall 122, top wall 124, side or outside wall 125 and upwardly converging end walls 126 and 127. The cartridge is assembled by joining the edges of the top, bottom and end walls and with the side walls generally parallel to one another. The cartridge 42 includes a pair of compartments 128 and 130 that are sometimes called front and rear compartments and/or new and used blades compartments. The two compartments are identical as they are used interchangeably depending upon the orientation of the cartridge 42 in the case 40. As has been stated above, the cartridge is initially filled with new blades in one compartment and the other compartment is empty but receives each blade after it's outside edge is worn. In this description, the edges of the blades 44 that are extended out of the compartments are sometimes called the outside edges as they lie close to the adjacent end walls 126 and 127 of the compartments. Furthermore, when all of the new blades in front compartment 128 are used and deposited in the rear compartment 130, the cartridge is reversed in the case so that the unused edge of each of the used blades may be utilized.

The two halves 120 that make up the cartridge may be connected together edge-to-edge by flexible interengageable hook-like tabs 132 and flanges 134 formed as integral parts of the case halves. The tabs and flanges are clearly shown in FIG. 9. When the identical halves 120 are placed edge-to-edge, the barbed tabs 132 engage the flanges 134 to hold the halves 120 together. Tabs and flanges 132 and 134 are provided along the edges of the bottom and top walls 122 and 124 and the end walls 126 and 127 to hold the cartridge in its assembled form. The tabs and flanges 132 and 134 are typical of a variety of different types of fasteners that may be employed to retain the two halves of the cartridge together. As it is intended that the cartridge be disposable under ordinary circumstances, and there is no need to open it after it is initially filled with blades, the tabs and flanges or whatever other means may be employed to assemble the cartridge halves together need not be releasable. Rather, once a cartridge is filled with blades by the manufacturer, there is no need ever to reopen the cartridge.

To assure proper alignment of the two halves 120 of the cartridge 42 when it is assembled, offsets 136 and recesses 138 are provided along the edge of the bottom wall 122, and end walls 126 and 127. The offsets and recesses in the bottom wall of the cartridge and in each of the compartments create an irregular longitudinal mating edge where the two halves 120 meet. This arrangement prevents the sharp bottom edges of the blades described below from getting caught in what otherwise would be a straight parting line in the cartridge floor. The tabs 136 and recesses 138 also serve to maintain the planar configuration of the floor formed by the edge-to-edge bottom walls 122. The two compartments 128 and 130 are separated and defined in part by a V-shaped wall 150 that may include additional tabs 132 and flanges 134 or other structure to facilitate the connection of the two halves. One side of each V-shaped wall 150 converges upwardly with the adjacent end wall 126 or 127 so as to configure the compartments 128 and 130 to complement the shape of the blades 44. This is shown particularly in FIG. 11.

Figure 10:
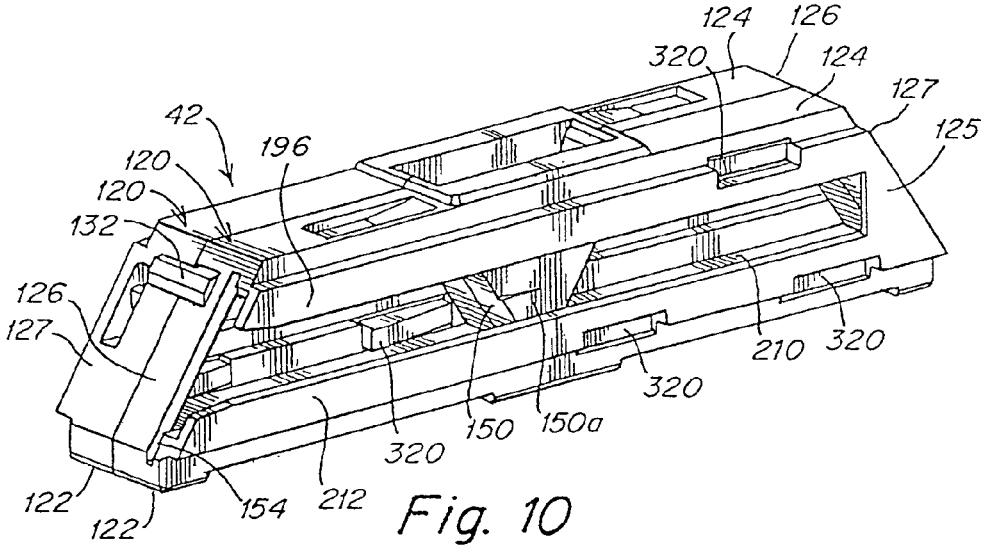
FIG. 10 is a perspective view of an assembled cartridge made up of two identical halves, one shown in FIG. 9.

It should be noted that end wall 126 of each cartridge half 120 includes a slot 154 adjacent the side wall 125 and through which the operative blade is extended while the other end wall 127 does not have such a slot (see FIG. 10). Therefore, when the two halves 120 are assembled, the slots at each end of the cartridge are on opposite sides adjacent different side walls 125, that is, they are not longitudinally aligned with one another but each is aligned with the slot 70 in the case when placed at the operative end of the case.

Figure 11:
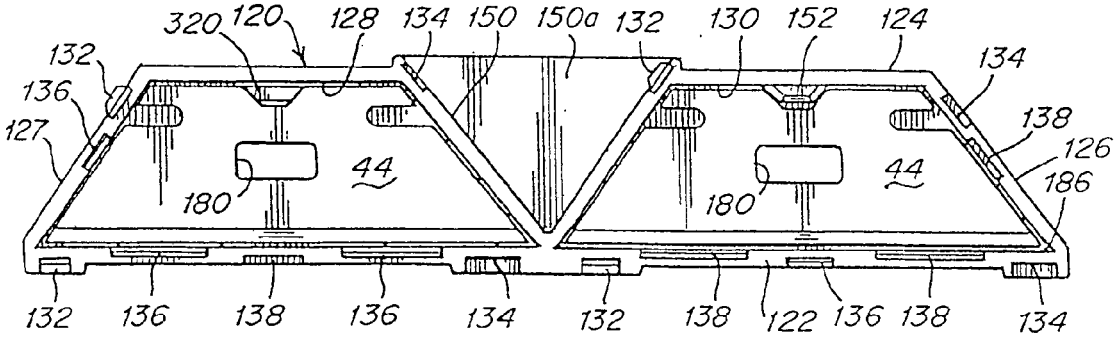
FIG. 11 is a side elevation view of one half of a cartridge showing blades disposed in each of the compartments.

A restrictor 152 is shown in FIG. 11 provided in the top wall 124 of compartment 130 for preventing certain movements of the blades. Specifically, the restrictor 152 prevents the blades in that compartment from moving into the center passageway of the cartridge that joins the two compartments or into the slot 154. This function is described in more detail in connection with the movement of the blades 44 in the cartridge 42.

Blades 44

The blades 44 (two embodiments shown in FIGS. 13 and 14) may take many different forms but in outline generally conform to the shape of conventional utility blades that are so widely used. The blades 44 may have straight cutting edges as conventional utility blades or may have "hook" style cutting edges that is also fairly well known in the utility knife industry as illustrated in FIG. 14. The blade in FIG. 13 includes a long cutting edge 170, upwardly converging end edges 172 and an upper edge 174 while the blade 44*a* in FIG. 14 has two hooks 170*a*, one at each end of its long edge, and upwardly converging end edges 172*a* and top edge 174*a*. Specifically referencing the blade 44 of FIG. 13, a notch 176 is provided in the center of the upper edge 174 sized to receive the restrictor 152 formed in the upper wall 124 of the compartments 128 and 130 of the cartridge. The restrictor limits certain motions of the blade as is described more fully below. Slots 178 in the end edges 172 are engaged by the carrier so as to selectively lift the blade when moving in either direction and pushes the blades in the operative direction toward the case front 66. Opening 180 at the approximate center of the blade body is engaged by a support in the carrier when the blade is moved in the cartridge and case between operative and inoperative or stored positions. Specifically, the support lifts the blade when moving either toward the operative or retracted positions but pushes the blade while moving the blade away from the operative position. As in conventional utility blades, the corners 182 of the cutting edge 170 are the principal portions of the blade that are utilized during conventional cutting operations. One corner 182 (the outside corner) of each blade is used as each is extended from the front compartment 128 of the cartridge 42 out the blade slot 70 in the case, while the other cutting corner 182 remains protected in the cartridge. After the one corner 182 of each blade from the front compartment is worn and each blade is moved to the rear compartment, the cartridge 42 is reversed in the case so that the unused corners 182 of the blades in the blade compartment 130 may then be utilized. The unused inside corners of the blades in the front compartment become the outside corners when the blades are moved to the rear compartment.

It will be noted in FIG. 11 that the corner 186 of the compartment 130 is enlarged to provide additional protection for the corner 182 of the blades when each is contained within a compartment of the cartridge. Both corners in each compartment of the cartridge are preferably enlarged in that fashion so as to provide further protection for the blade 44 and eliminate binding of the blade corners in the tight corners of the compartments.

Figure 13:
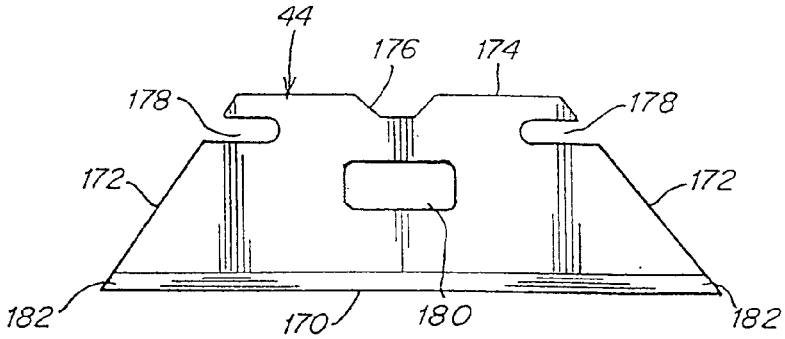
FIG. 13 is side elevation view of one embodiment of a blade constructed in accordance with one aspect of the invention and which may be packaged with other identical blades in the cartridge.
Figure 14:
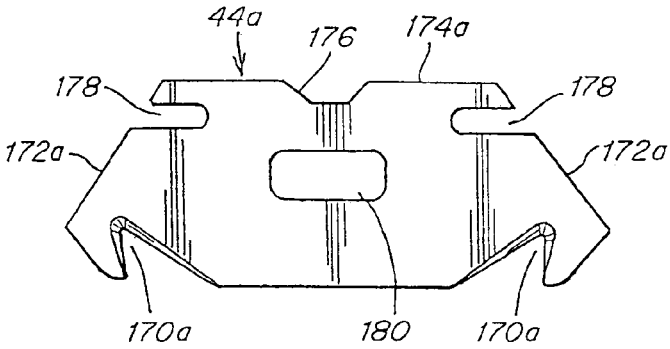
FIG. 14 is a side elevation view of another blade that may be packaged with other like blades in the cartridge and used in the knife of this invention.

It will be appreciated that the "hook" blade of FIG. 14 will function just as the utility blade 44 of FIG. 13 within the cartridge and move in it from one compartment to the other as the outside hooks are used.

Carrier 46

Figure 12:
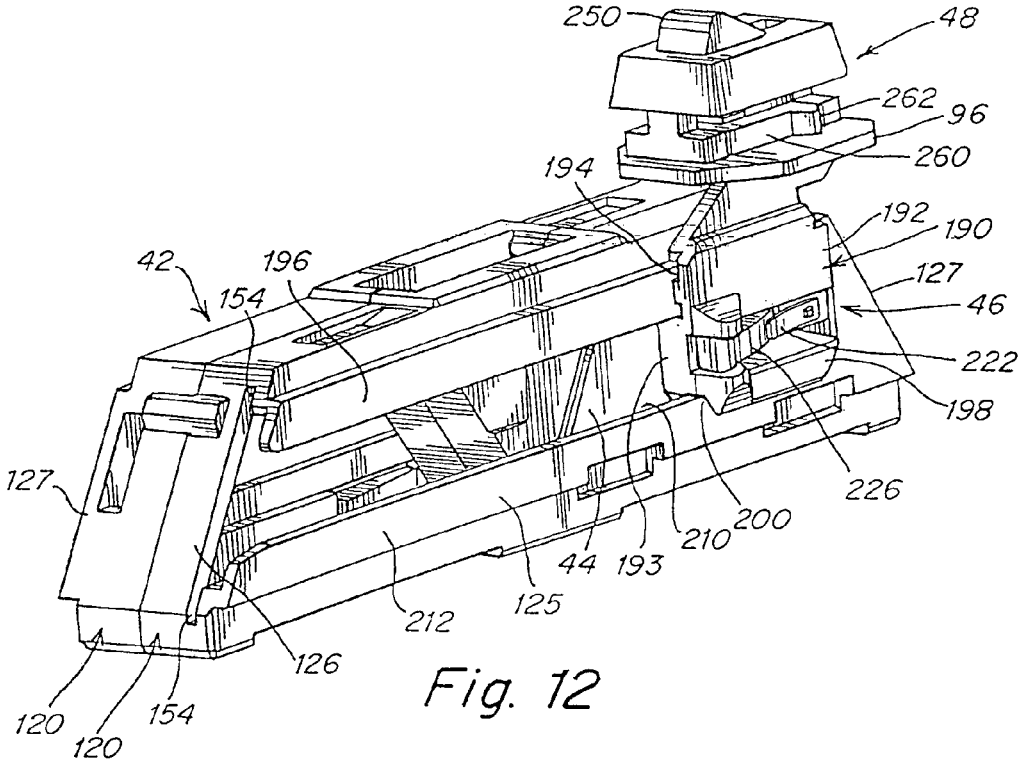
FIG. 12 is a perspective view of the cartridge similar to FIG. 10 and showing the carrier and actuator subassembly mounted on it.
Figure 15:
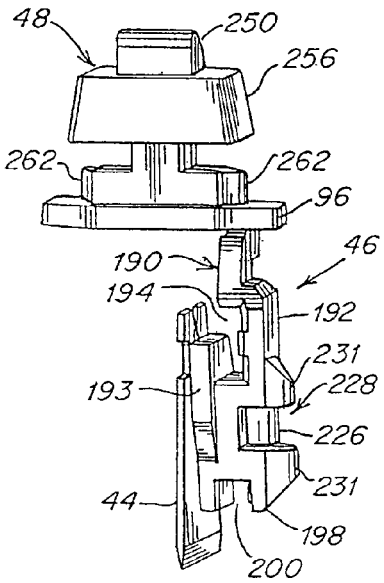
FIG. 15 is an end perspective view of a blade, carrier and actuator assembly.
Figure 16:
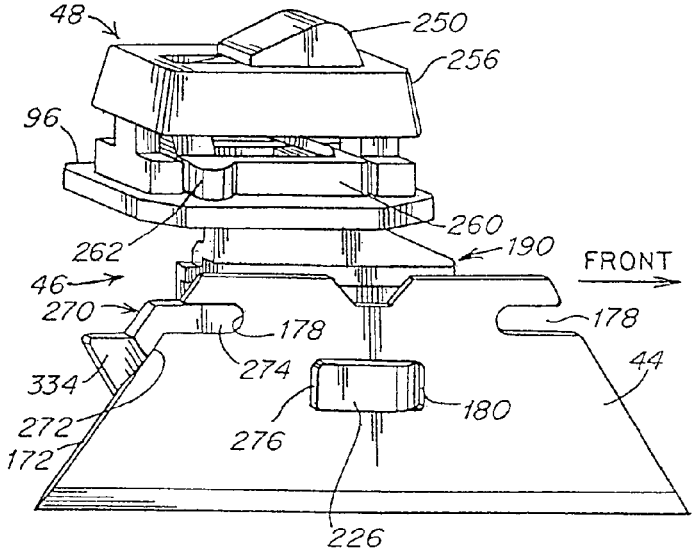
FIG. 16 is a side perspective view of the assembly shown in FIG. 15.
Figure 17:
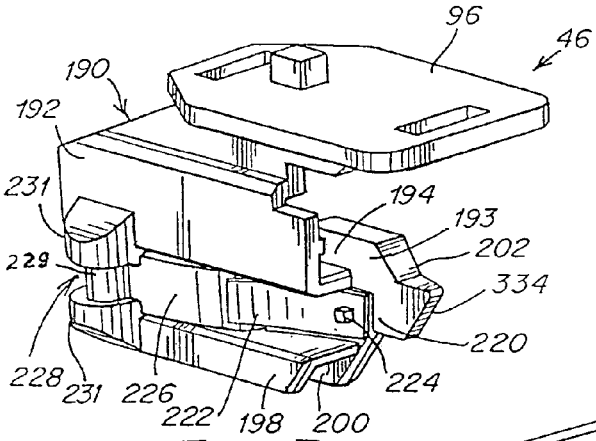
FIG. 17 is a perspective view of the actuator but viewed from the side opposite that of FIG. 16.

The carrier 46 shown in FIGS. 6, 7, 12 and 15–20 transports the blades 44 one at a time to the various stored and operative positions in the case 40 and cartridge 42. The actuator 48 is shown in FIGS. 12, 15 and 16 to be attached to the carrier 46, and the two move together as the blade 44 moves from one position to another. The carrier includes the upper panel 96 shown disposed in a horizontal plane within the channel 94 in the case (see FIGS. 5–7) and has a depending body 190 that actually engages the blades. The body 190 has an offset portion 192 that defines with panel 193 an upper channel 194 that receives an upper rail 196 (see FIGS. 6 and 7) forming part of the cartridge 42. The body 190 of the carrier also includes a second offset portion 198 that defines a second lower channel 200 that receives a lower rail 212 in the side of the cartridge 42. The interlocking relationship of the rails 196 and 212 with the carrier channels 194 and 200 assures that the carrier precisely engages the blades and moves each from one end of the case to the other and out the case through the slot 70 at the front end of the case during its transitions in use. An enlarged longitudinal slot 210 formed on the side wall 125 of the cartridge receives the panel 193 of the body 190 so as to provide further support and guidance for the carrier as it moves longitudinally in the case. Note that the rails 196 and 212, and slot 210 are duplicated on both sides of the assembled cartridge 42.

Figure 19:
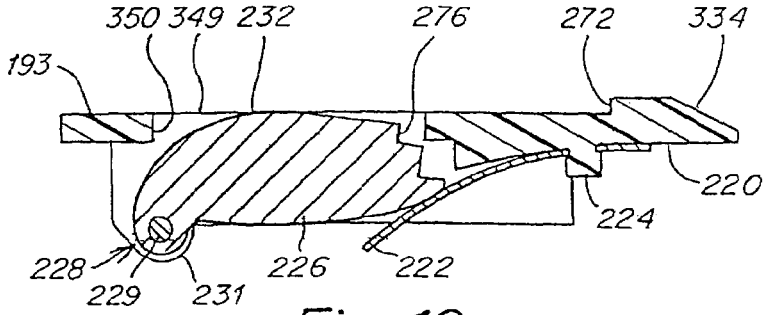
FIGS. 19 and 20 are detailed horizontal cross-sectional views respectively showing the support forming part of the carrier and engaging a blade as in FIG. 16 and retracted and not engaging a blade.
Figure 20:
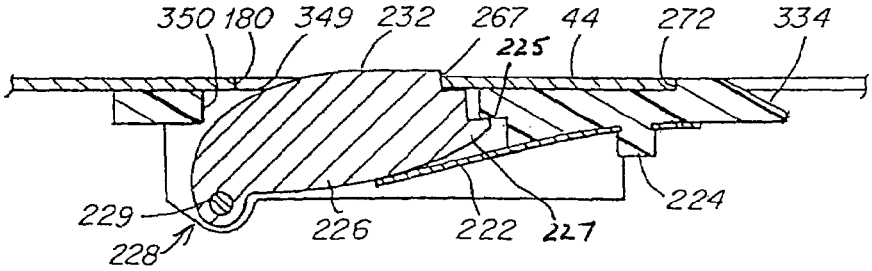

The outside surface 220 of the central portion 202 of the carrier body 190 (the surface facing away from the cartridge) carries a flat metal spring 222 (see FIGS. 17, 19 and 20) supported on the surface by an anchor pin 224. The spring 222 bears against a support 226 pivotally mounted on a hinge 228 provided on the carrier 46. The hinge 228 includes a pivot post 229 supported by bosses 231 in turn mounted on the offset portion 192 and offset portion 198. In FIGS. 19 and 20 the two positions of the support 226 are shown. In FIG. 20 the support is shown seated on the edge 349 of the opening 350 in the panel 193 with its side portion 232 disposed in the hole 180 of the blade. In FIG. 19, the support is moved away from the blade 44 (the side portion is withdrawn from the hole 180) against the bias of the spring 222. As described more fully below, the squared edge 276 of the support engages the side of the hole 180 in the blade to move the blade rearwardly in the case to either of its retracted positions. As shown in FIGS. 19 and 20 the side portion 232 of the support 226 away from the squared edge 276 is rounded so that the support can be deflected against the bias of the spring 222 and ride over the blade surface until it snaps into the hole 180 as the support moves forwardly from the rear to the front compartment as it is picking up the next blade.

In FIGS. 6 and 7, the configuration of the cartridge is shown to be the same on both sides so that when the cartridge is reversed in the case with the other outside wall 125 facing the carrier, the carrier can move into the cartridge and engage the blades one at a time and move them through the cartridge and case between the rear compartment and the very front of the case with the blade extending out of the case 40 through slot 70 in its operative position.

Figure 18:
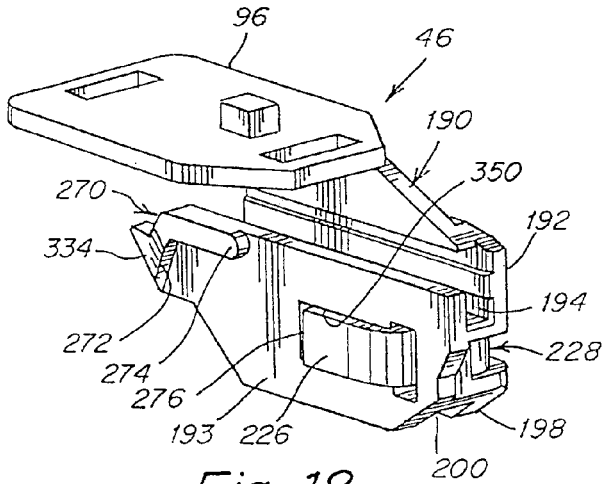
FIG. 18 is a perspective view of the carrier showing the face thereof hidden by the blade in FIG. 16 and opposite the side shown in FIG. 17.

Referring to FIGS. 16 and 18, the panel 193 carries a lifter and pusher combination 270 that engages the end edge 172 and slot 178 of the blade 44. The surface 272 of the pusher/lifter is positioned at the rear edge of the blade to push the blade in a forward direction (to the right as viewed in FIG. 16) as the carrier moves in that direction. Similarly, the flange portion 274 of the pusher/lifter combination also is positioned to push the blade in that direction as it bears against the inner end of slot 178 in the blade, and it also lifts the blade by engaging the top of the slot 178. The support 226 urged into position by the spring 222 also serves to lift the blade when positioned in the blade central hole 180 and the edge 276 of the support bears against the rear edge of the hole so as to push the blade rearwardly with respect to the case and cartridge as the carrier moves in that direction.

Actuator 48

Figure 21:
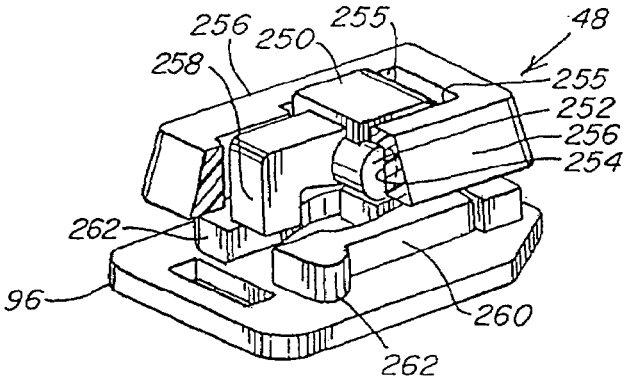
FIGS. 21 and 22 are perspective views of the actuator in its unlocked and locked positions, respectively.
Figure 22:
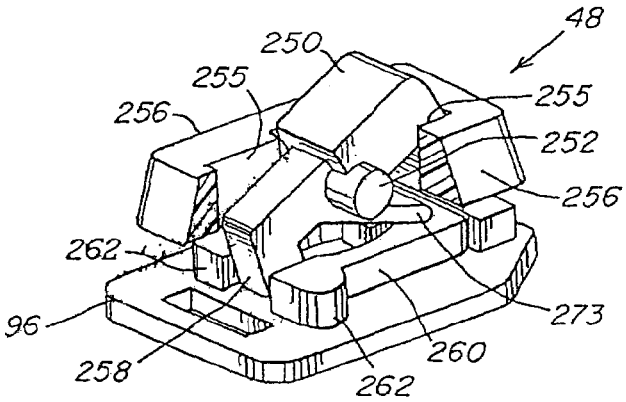
Figure 23:
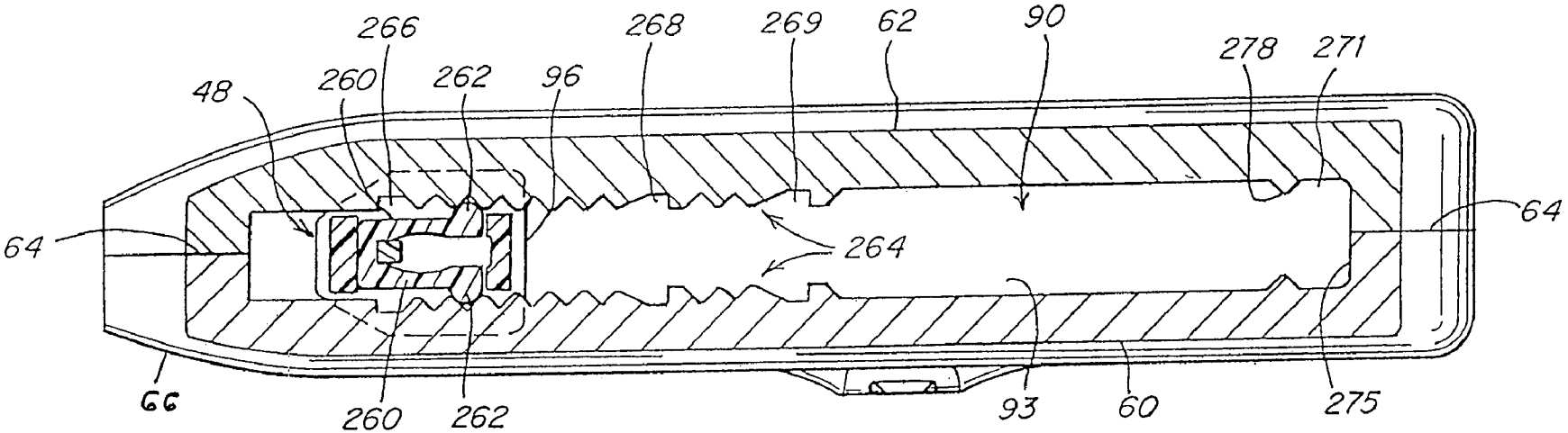
FIG. 23 is a horizontal cross-sectional view of the knife case and actuator taken along section line 23—23 in FIG. 2 and showing the locking arrangement for the actuator and carrier.

The actuator 48 is shown in FIGS. 15, 16, and 21–23 mounted on the panel 96 of the carrier. In FIGS. 21 and 22 the actuator is shown in its unlocked and locked condition, respectively. The actuator includes a rocker 250 supported by an axle 252 mounted in cavities 254 on the opposed walls 255 of arms 256 that are part of the frame of the actuator. The rocker 250 includes a stop 258 that when moved to the lower position shown in FIG. 22 is disposed between the ends 262 of spring arms 260 and prevents the arms from flexing toward one another. The ends 262 of the arms register with the racks 264 formed along the sides of the slot 90 in the case as shown in FIG. 23. When the rocker is moved to the position shown in FIG. 21 so that the stop 258 is out from between the ends 262 of the spring arms 260, the ends 262 are free to move toward one another and essentially run over the teeth of the ratchet sections 264 in the slot 90 and allow the actuator 48 to move along the top of the case and carry the carrier 46 with it. However, when the rocker 250 is in the position of FIG. 22, the actuator 48 cannot move, and the carrier is also locked.

In FIG. 23 the ratchet sections 264 are shown to have several locking stations 266, 268 and 269. In addition, a fourth locking station 271 is established by the barbs 278 spaced from the rear end 275 of slot 90. When the ends 262 of the springs 260 are disposed in any of the stations 266, 268, 269 or 271 and the stop 258 of the rocker is lowered to a position between the ends 262 as shown in FIG. 22, the actuator is locked in that position and cannot move, and the carrier and blade are locked as well. Thus, in order to move the carrier 46 so as to move a blade, the actuator rocker must be placed in the position shown in FIG. 21.

Preferably the rocker is biased to the locking position of FIG. 22 and for that purpose, the rocker carries an extension 273 that bears against the spring arm component 260 and acts as a spring to urge the rocker to pivot counterclockwise on its axle 252 as viewed in FIGS. 21 and 22 and move the stop between the spring arms 262.

Movement of Carrier in Operation of Utility Knife

Figure 24:
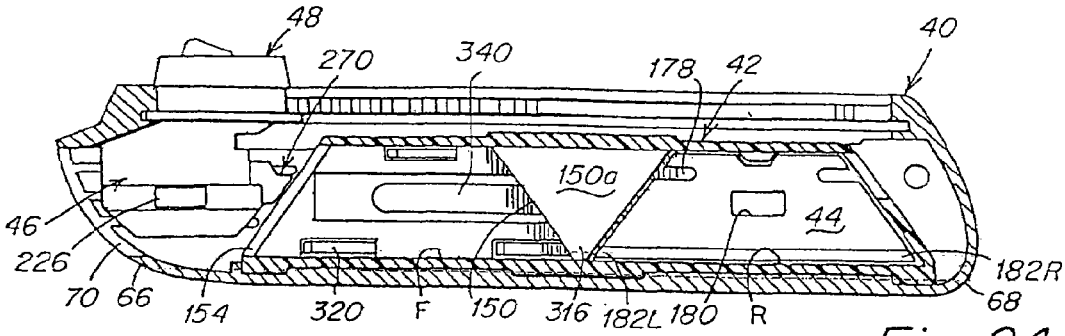
FIGS. 24–28 are vertical cross-sectional views similar to FIG. 3 on a reduced scale and illustrating the carrier, actuator and blades in various positions in the knife case.

In FIGS. 24–28 the various positions of the carrier are shown that allow the cartridge to be replaced and that sequentially move new blades from the front compartment to the operative position, retracted position and finally to the rear compartment when each worn blade requires replacement. In FIG. 24 the cartridge 42 is shown with all of the blades 44 in the rear or used blade compartment R—no blades are in the front new blade compartment F. In this situation, the cartridge 42 must either be replaced as required when both corners 182 of each blade 44 have been used, or reversed with the compartment R at the front of the case when just one corner of each blade is worn. To reverse or replace the cartridge, the carrier 46 must be moved to the front of the case 40 fully detached from and out of the cartridge 42 as shown in FIG. 24. If the cartridge 42 of FIG. 24 is reversed, chamber R would be disposed at the front end of the case and chamber F would be disposed at the rear. As a result, all of the blades 44 in compartment R would be disposed at the front end of the case 40 with the unused ends 182R of the blades at the front end of the case, and the compartment F at the rear would again be empty. The same, of course, would be true if the cartridge 42 were replaced with a new one.

Figure 25:
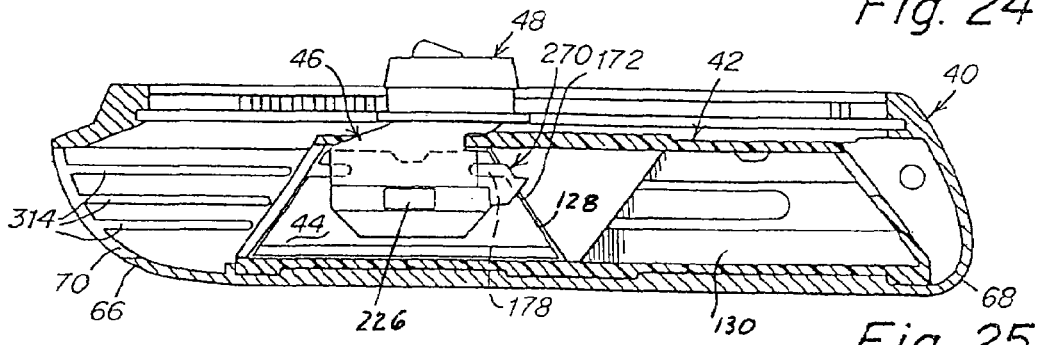
Figure 26:
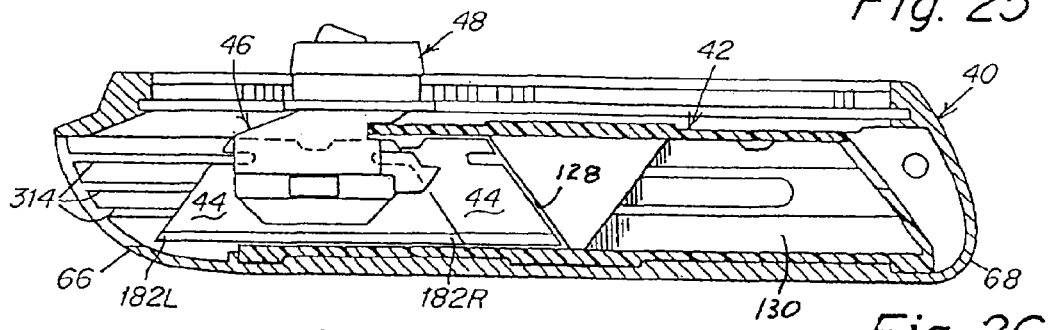

In FIG. 25 the carrier 46 is shown in position to engage the first blade 44 in the front compartment by means of the support 226 and the pusher/lifter 270 of the carrier as described above in connection with FIGS. 16–20. The pusher/lifter 270 engages the rear slot 178 in the rear end edge 172 of the blade. When the blade is engaged in that fashion, the carrier may be moved towards the front end 66 of the case and that motion carries the blade with it toward the slot 70 in the case 40. In FIG. 26 the blade 44 is shown partially removed from the front compartment of the cartridge, but is contained fully within the case, and in FIG. 27 the blade is shown in its operative position extending almost entirely out of the cartridge and its leading cutting edge 182L is fully exposed beyond the slot 70 in the case. The carrier as it moves toward the back end 68 of the case pushes the blade with it by virtue of the engagement of the squared edge 276 of the support 226 with the rear edge of the hole 180 in the blade. It should be noted that to move the blade from one position to another, the rocker 250 of the actuator 48 must be in the unlocked position. However, when the blade is not to move such as when it is in use, the rocker 250 is placed under the influence of spring extension 273 in the locking position of FIG. 22 so as to prevent the carrier 46 from moving.

Figure 27:
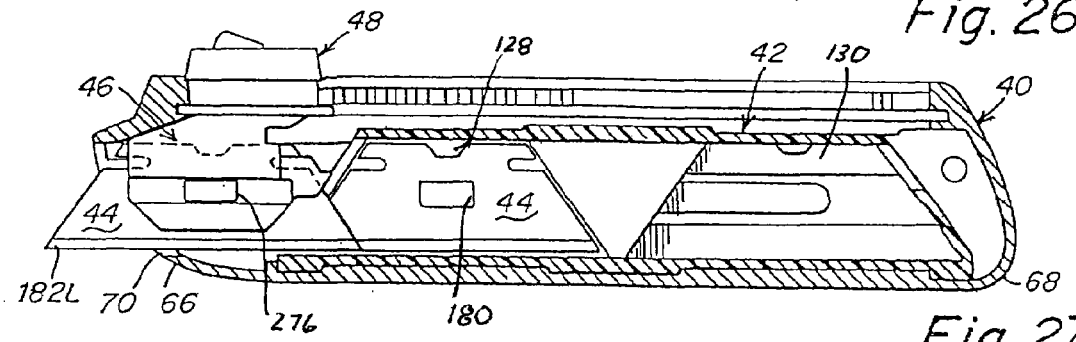
Figure 28:
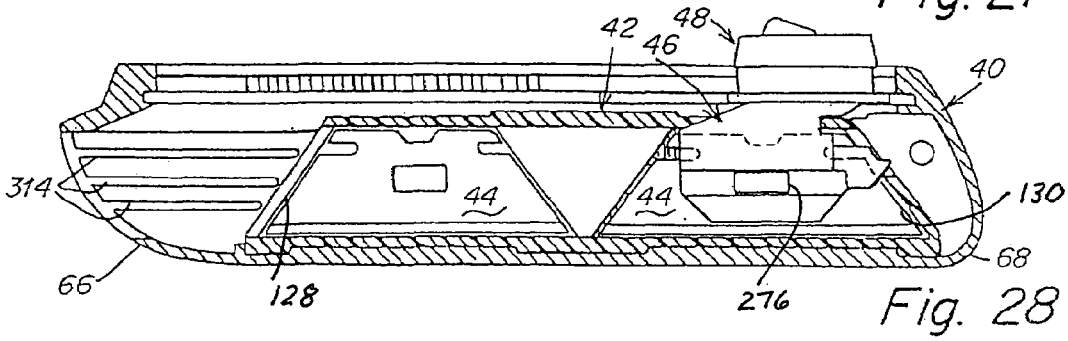

If the forward cutting edge 182L of the blade 44 is not worn and the knife is not to be used for a period of time, the carrier 46 may be returned to the position shown in FIG. 26 and the actuator should be locked so that the blade 44 and particularly its leading edge 182L is fully contained within the case so as not to be exposed and cause accidental injury. When the utility knife is to be used again, the carrier may again be moved in a forward direction by unlocking the actuator, so as to expose the working end 182L of the blade as shown in FIG. 27. When the utility blade forward cutting edge 182L is no longer suitable for performing its intended cutting function, the blade is moved to the rear compartment by sliding the actuator 48 and carrier 46 to the position shown in FIG. 28. In that manner, the blade is deposited in the rear used blade compartment, and the carrier may then be moved forward to the position shown in FIG. 25 to pick up the next blade in order in the front or new blade compartment. The carrier may be locked in any one of the positions illustrated in FIGS. 24–28 by the ratchet-like mechanism provided in the actuator and slot 90 in the top of the case as shown in FIG. 23, all as described in detail below.

Interaction of Cartridge 42, Blade 44 and Carrier 46A

Figure 29:
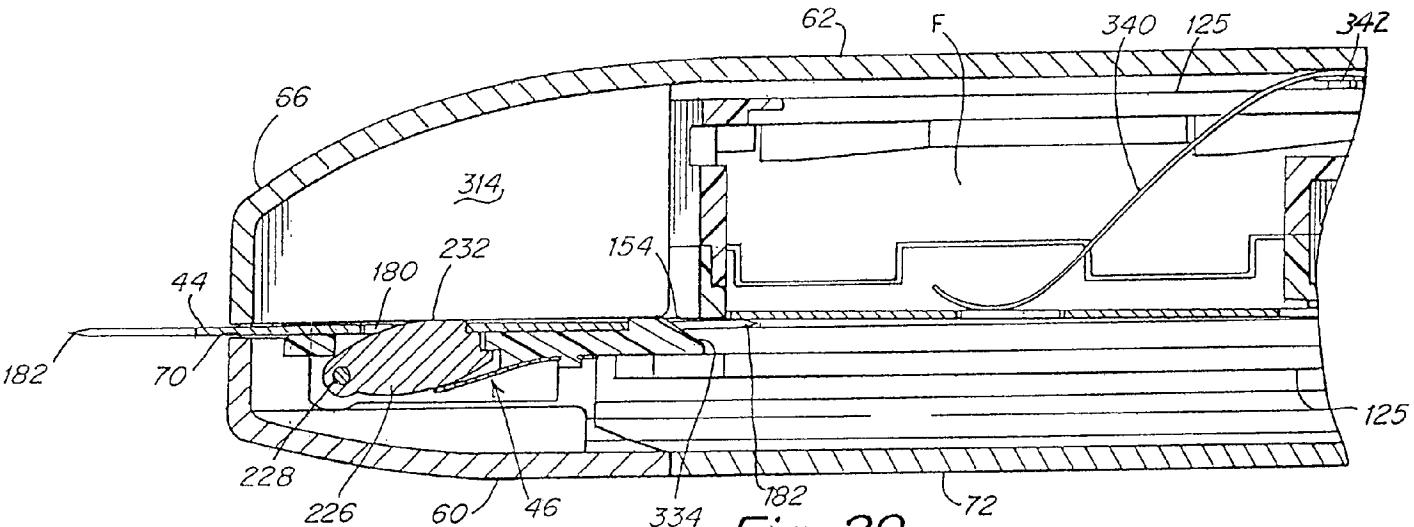
FIG. 29 is an enlarged, fragmentary, horizontal, cross-sectional view of the front end of the knife showing the carrier and a blade advanced to the operative position.

The interaction of the cartridge 42, carrier 46, and blade 44 as illustrated in FIGS. 29–41 enables the utility knife to function in the manner shown in FIGS. 24 through 28. In FIG. 29 the support 226 is shown with its outer portion 232 disposed in the hole 180 of the blade 44, and the blade extends out of the opening 70 in the front end 66 of the case. The carrier moves the blade to that position by virtue of the connection between the pusher/lifter 270 on the carrier and the slot 178 in the blade shown in FIG. 16. The rear end of the blade is shown disposed in the slot 154 in the cartridge, which is wide enough to allow only one blade at a time to pass through it. Thus, only one blade at a time can be moved from the front compartment of the cartridge to the operative position shown in FIG. 29. The rear corner 182 of the blade remains in the front compartment of the cartridge to prevent the next blade in the stack of blades in the front compartment from moving into a position that would block the blade path (slot 154) when the carrier retracts the operative blade into the cartridge either in the position suggested in FIGS. 26 or rearwardly thereof anywhere back to the position shown in FIG. 28. The blade 44 carried by the carrier is held in position by the blade guides 314 shown in FIGS. 3, 4, 5, 25, 26 and 28. The guides which form part of the case hold the active blade against the carrier when the carrier is outside the cartridge.

Figure 30:
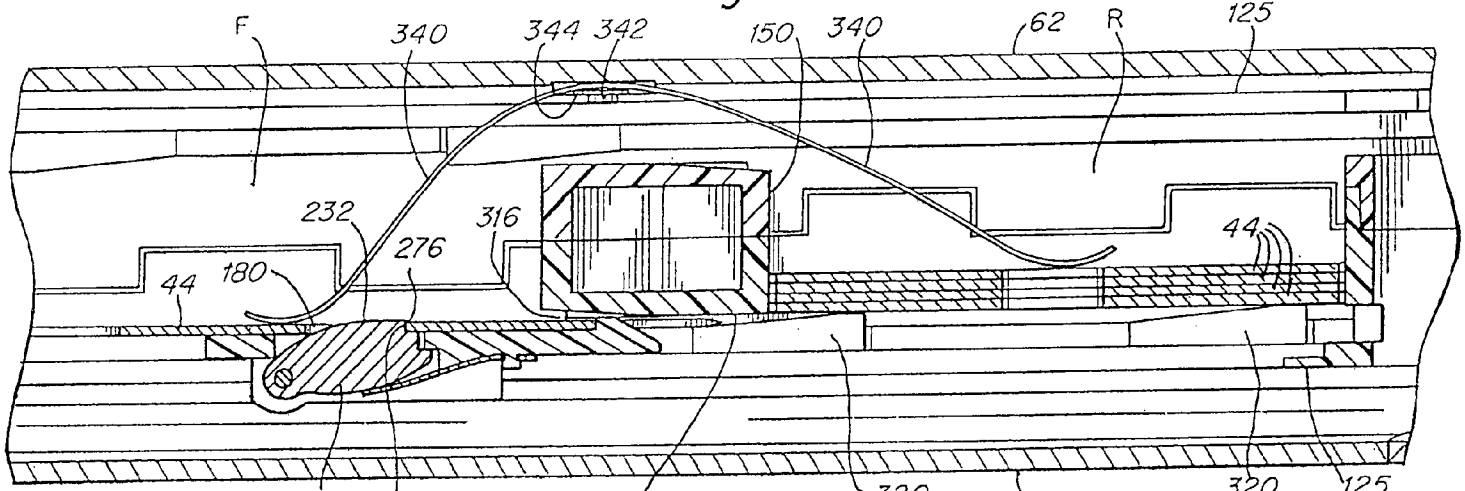
FIG. 30 is a view similar to FIG. 29 and showing the carrier moved rearwardly in the case toward the rear compartment to deposit a used blade in it.
Figure 31:
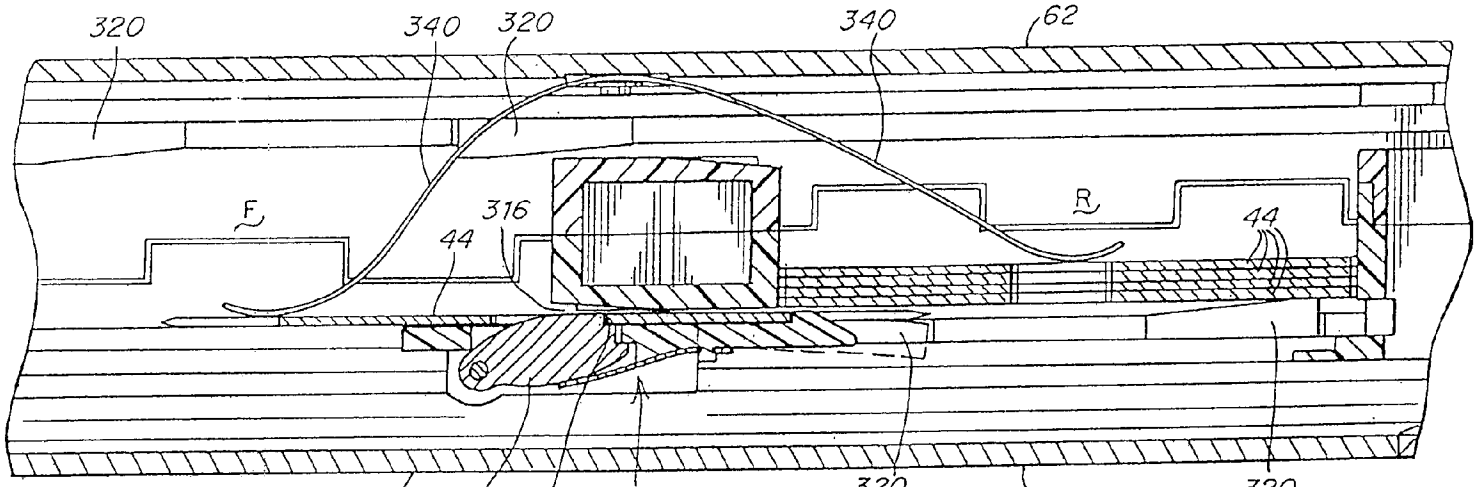
FIG. 31 is a view similar to FIG. 30 showing the carrier moved further back with the used blade toward the rear compartment.

In FIGS. 30 and 31 the carrier is shown moving the blade 44 through the center passageway 316 that connects the front and rear compartments F and R in the cartridge. The edge 276 of the support 226 is shown bearing against the rear edge 318 of the hole 180 so as to move the blade in the rearward direction. The center passageway 316 is also wide enough to receive only one blade at a time. The center passageway 316 is shown in FIG. 6 between the side wall 125 of the cartridge 42 and a wall 150*a* that joins the ends of the cartridge V-shaped wall 150.

The used blades in the rear compartment are held out of the way of incoming blade 44 by means of springs 320. The springs 320 may be formed as an integral part of the cartridge. In FIG. 31, the blade 44 engaged by the carrier 46 is shown entering the rear compartment of the cartridge. As the blade enters the compartment it temporarily displaces the first spring 320 out of the way so as to enable the blade on the carrier to enter. The rearmost spring 320 assists in displacing the other blades in the rear compartment.

Figure 32:
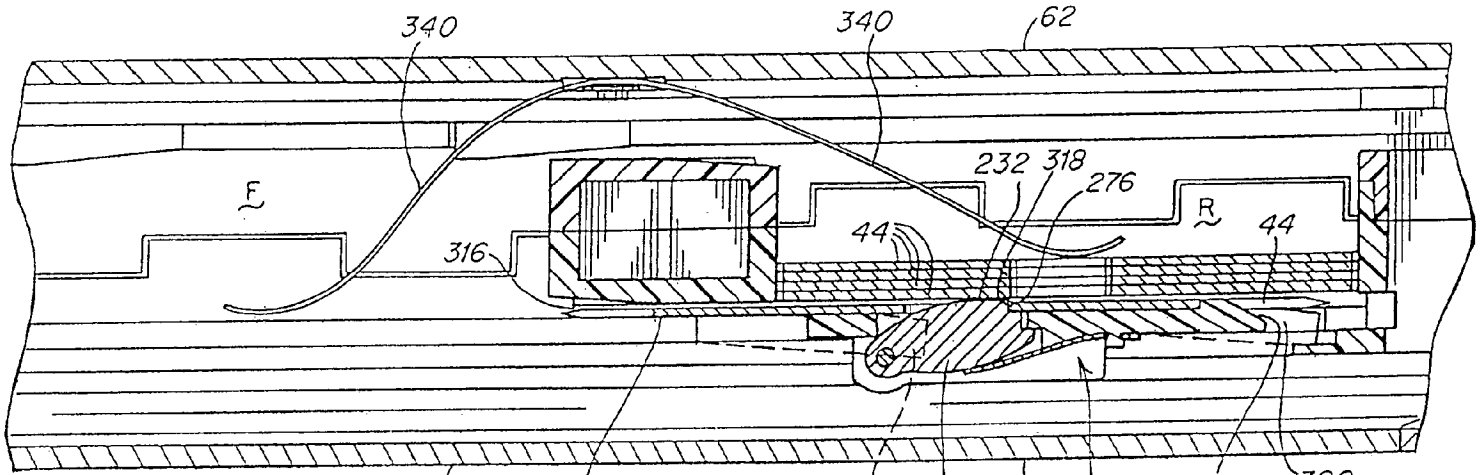
FIG. 32 is a view similar to FIG. 31 showing the used blade yet further back in the rear compartment about to deposit the used blade in it.

In FIG. 32 the blade 44 is shown carried by the carrier further back in the rear compartment, pushed along by the edge 276 of support 226 bearing against the rear edge 318 of the blade hole 180. When the carrier and blade 44 are completely through the passage 316 and therefore free of the frictional binding effect of the center blade passageway 316 on the end of the blade, the springs 320 eject the blade 44 off the carrier and particularly off the support 226. The springs 320 are returned to their biased position to hold the used blades in the rear compartment out of the path of the next blade to be deposited in that compartment as in FIG. 30. The carrier 46 is then free of the blade deposited in the rear compartment and can move forward toward the new blade compartment to engage the next blade in the stack. If there are no more blades in the new compartment, the carrier may be moved to the forward most position as shown in FIG. 24 so that the cartridge may be replaced or reversed.

Figure 33:
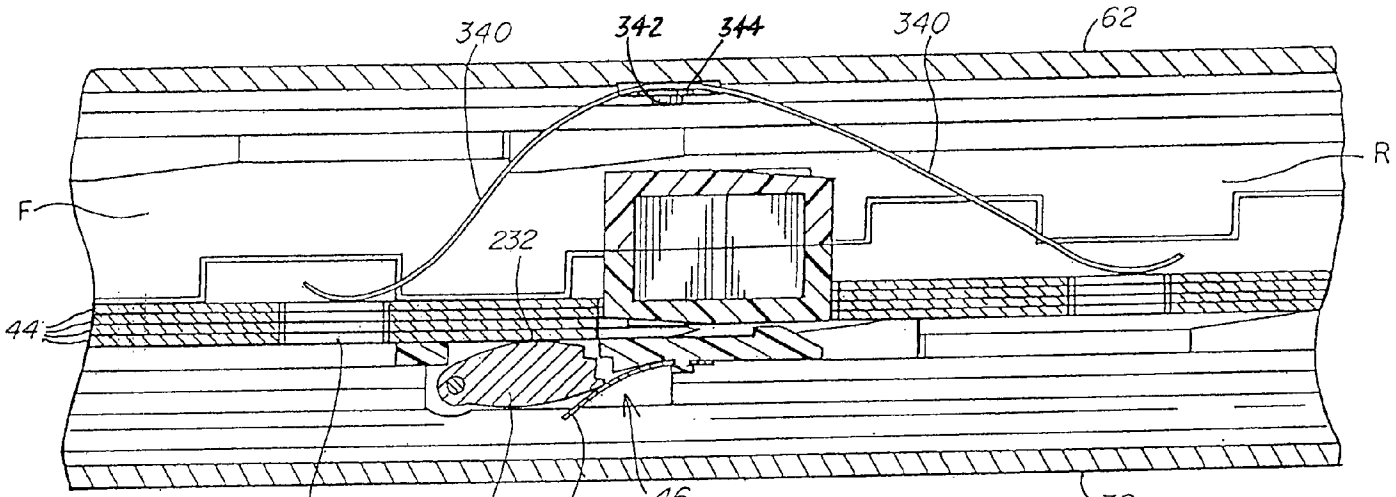
FIG. 33 is a view similar to FIG. 32 and showing the empty carrier approaching a new blade in the front compartment.

In FIG. 33 the carrier 46 is shown moving in the direction of the new blade compartment to engage the next blade in order. The hinge mounted support 226 is displaced against the bias of spring 222 as it encounters the next blade 44 in the new blade compartment F. The support 226 remains displaced as shown in FIG. 10 until it is aligned with the hole 180 in the next blade and is forced into the hole by the bias of the spring 222. At the same time, the pusher/lifter 270 at the rear end of the carrier 46 engages the slot 178 in the blade (see FIG. 16) so that the carrier may move the blade out of the front compartment to the operative position when it is to be used.

When the blade 44 is to be withdrawn fully into the cartridge 42, no interference can be encountered from the other blades in the front compartment because the rear corner 182R has not been withdrawn from it (see FIG. 27) and therefore it maintains the displacement of those blades in the compartment.

Figure 34:
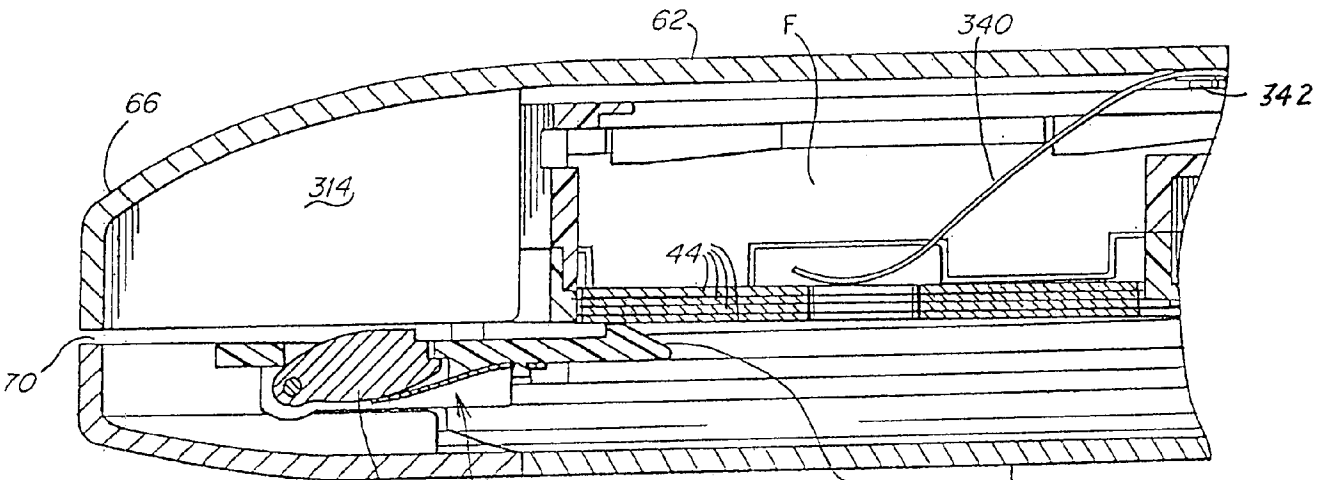
FIG. 34 is a view similar to FIGS. 29–33 and showing the carrier empty and moving rearwardly in the case to pick up the first blade in the front compartment after a new cartridge has been inserted in the case or the cartridge has been reversed.

If the carrier is positioned as shown in FIG. 34 and does not carry a blade, (the cartridge has either been reversed or replaced), the wedge 334 on the rear of the carrier displaces the blades in the front compartment F to allow the carrier to enter and engage the first blade in the stack. This action is shown in FIG. 34. The wedge 334 is also shown in FIGS. 16, 19 and 20.

A pressure spring 340 bears against the rear of the stack of blades in each compartment (see FIGS. 30–34) and continuously yieldably pushes both stacks toward the carrier 46 to insure proper engagement. The spring is mounted on a post 342 on the rear shell 62 of case 40 and retained in place by lock washer 344.

Figure 35:
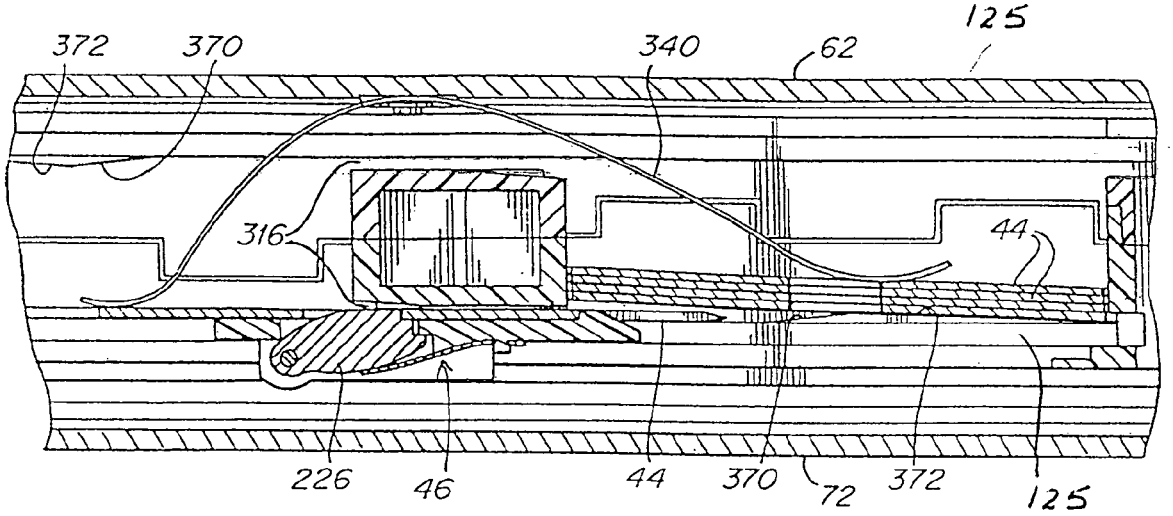
FIGS. 35 and 36 are enlarged, fragmentary horizontal cross-sectional views of an alternative knife construction showing the carrier moving a used blade into the rear (used blade) compartment beside previously stored blades in that compartment.
Figure 36:
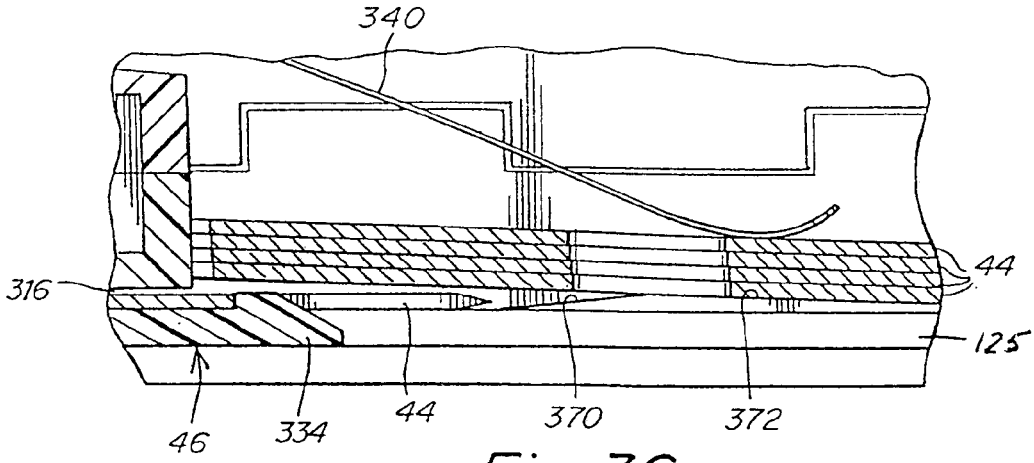
Figure 37:
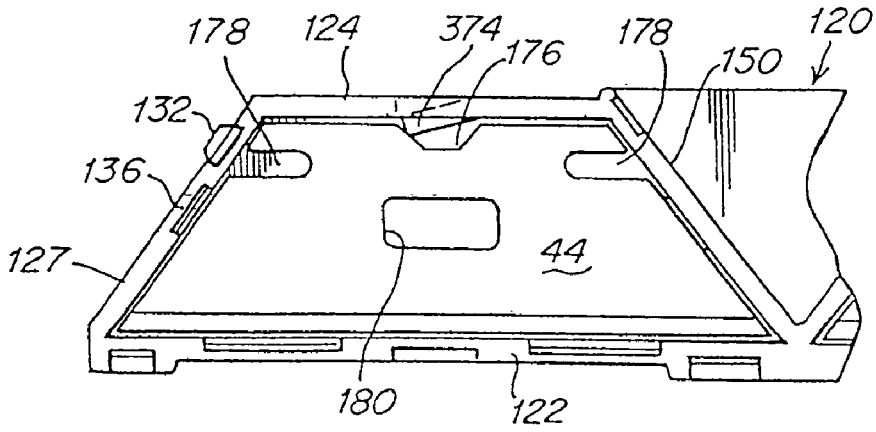
FIG. 37 is a vertical side elevation view of a cartridge half and having a blade restrictor in the front compartment for preventing new blades from inadvertently moving rearwardly into the passageway between the compartments toward the used blade compartment but permits the blade to move to the slot in the front of the knife.

In FIGS. 35 and 36, an alternative construction is shown to displace the blades in the rear compartment out of the path of the incoming used blade and to free the incoming blade from the carrier 46 and the edge 276 of support 226. For this purpose, a ramp 370 and support surface 372 are provided in the side wall 125 and replace the springs 320 shown in FIGS. 30–32. In FIG. 35 the rear ends of the carrier 46 and blade 44 are shown approaching ramp 370, and the blades already in the compartment are displaced away from the path of the blade by the surface 372. Continued rearward travel of the carrier and its blade causes the blade to assume the orientation of the surface 372 and allows the carrier to move freely in the opposite or forward direction. There is nothing on the forward curved surface of the support 226 to engage the blade and to interfere with the forward movement and the support 226 will not drag the blade with it.

When the cartridge 42 with the blades 44 in the rear compartment is out of the case, the spring 340 which remains in the case is not available to urge the blades into the position shown in FIGS. 35 and 36, and the front most blade in the stack may lodge in the center passageway 316. To prevent that from occurring, a restrictor 374 formed as an integral part of the top wall 124 of the cartridge (see FIG. 37) engages the notch 176 in the top edge of the blade. The restrictor 374 acts as a flexible finger to allow a blade to enter the compartment through the center passageway 316 but not to leave the compartment through it.

Figure 38:
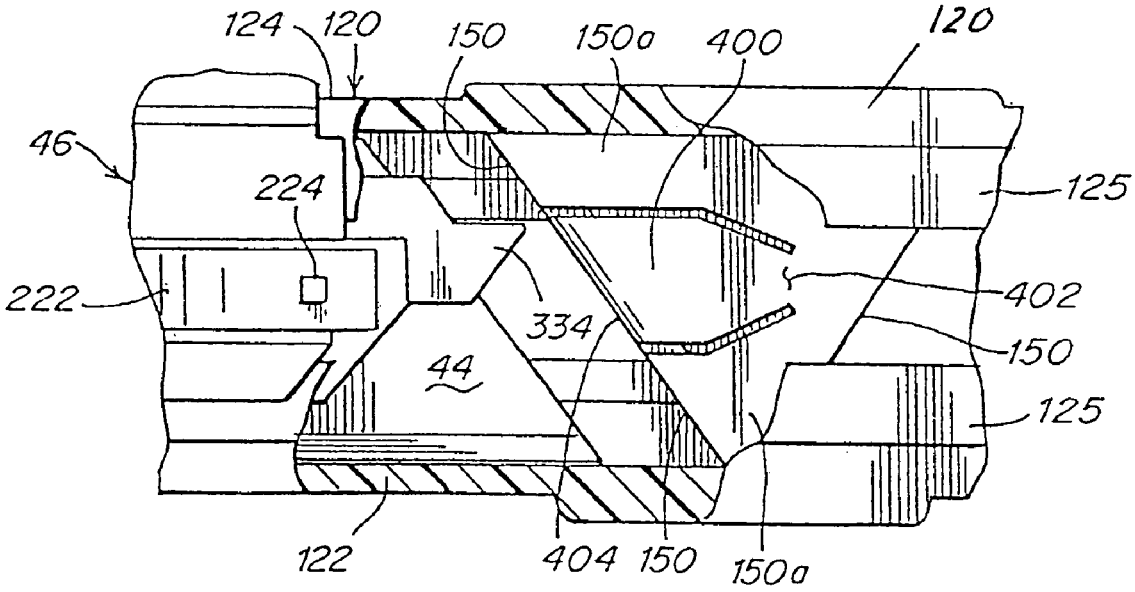
FIG. 38 is a fragmentary elevation view partly in section showing a gate that controls the movement of blades through the passageway from the front to the rear compartment.
Figure 39:
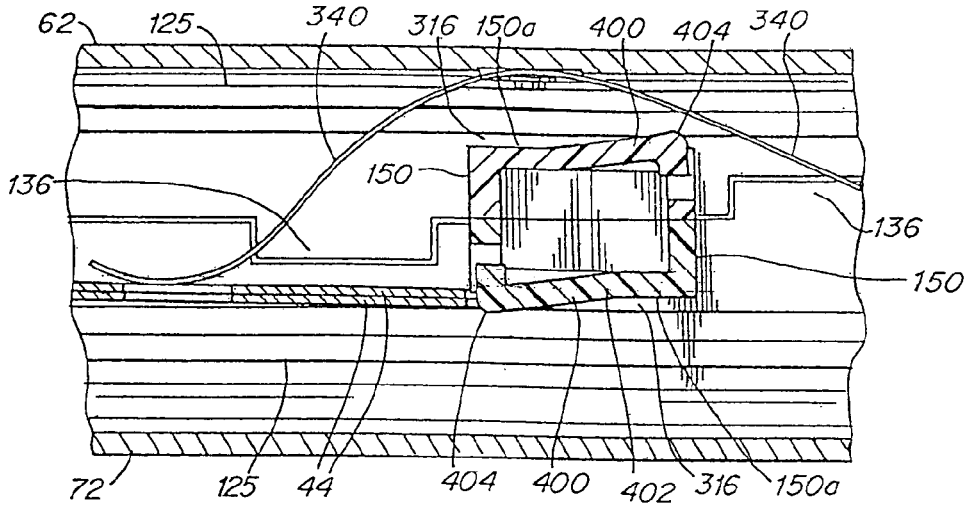
FIGS. 39–41 are fragmentary cross-sectional views of the gate guarding the passageway between the compartments and respectively showing the gate closed, in the process of being opened, and fully opened allowing a blade into the rear compartment
Figure 40:
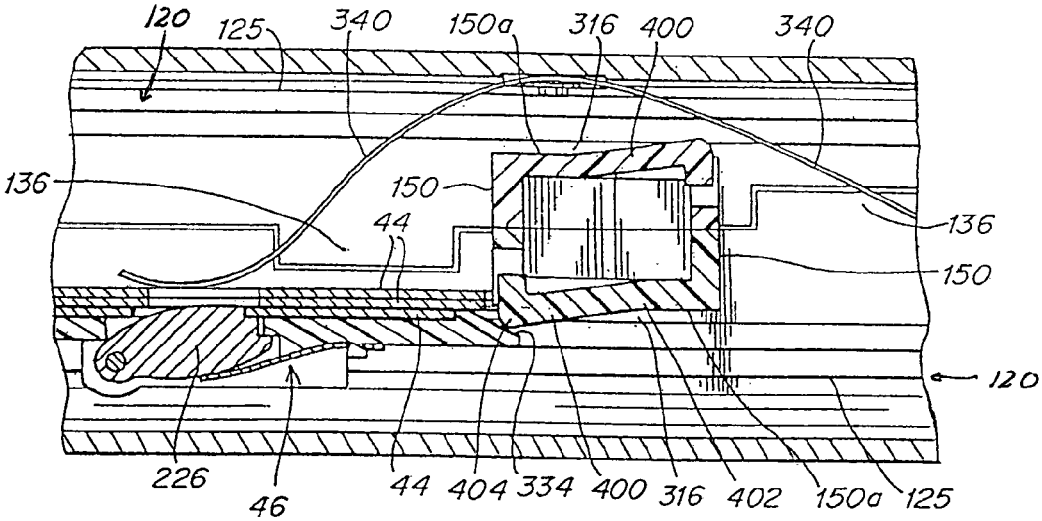
Figure 41:
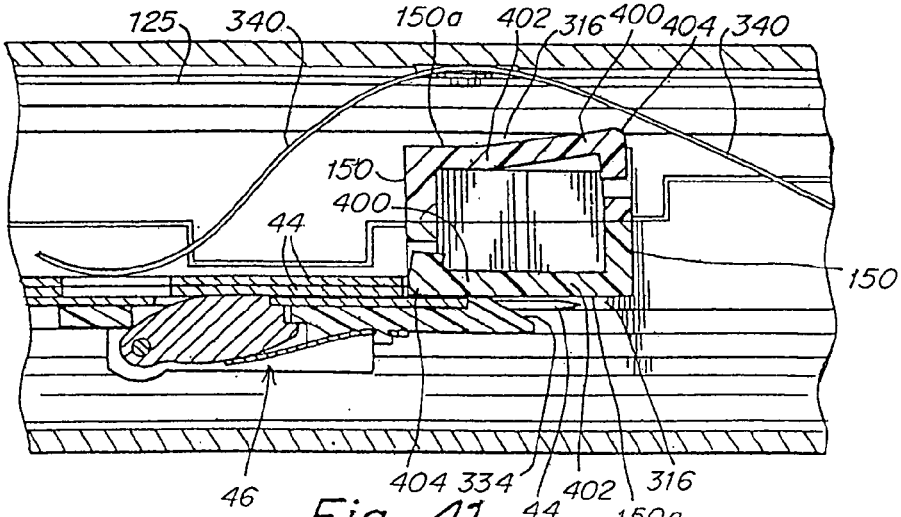

Another embodiment of the invention is shown in FIGS. 38–41. In accordance therewith a gate system is employed to further insure that an additional blade is not drawn into the center passageway 316 between walls 150*a* and 125 when a blade is being moved through the front compartment toward that passageway on the way to the used blade compartment. The gate system includes a gate 400 formed as an integral part of each cartridge half 120. The gate is carried on a live hinge 402 that positions the free end 404 of the gate in the center passageway 316 (see FIG. 39) but allows it to move inward out of the passageway at the urging of the wedge 334 on the rear end of the carrier (see FIG. 40). A front elevation of the gate 400 and hinge 402 is shown in FIG. 38. In FIG. 41 the gate 400 is fully open allowing the blade 44 and carrier 46 to pass through the passageway 316 on its way to the rear compartment.

In the foregoing description the invention has been directed to a utility knife using traditional sized blades customarily approximately 0.025 inches in thickness. In such an application of this invention the passageways 154 and 316 may be approximately 0.037 inches, less than the thickness of two blades (0.050 inches) and nevertheless providing enough clearance to allow one blade at a time to comfortably pass through them. It should be appreciated that the invention has wider application than simply with utility knives and the invention is not to be limited to that specific use.

In the foregoing description many components have been described as being integrally formed together with other components in the knife. For example, certain springs, ramps, gates, etc. have been described as being integral with the main parts 120 of the cartridge 46. However, it is important to recognize that these and other components may be fabricated as separate parts and subsequently be assembled together to form the cartridge. The same applies to the various parts of the case 40, carrier 46 and actuator 48. While parts may have been characterized in the description as being integral with one another, the present invention is not confined to that specific form as it is within the scope of the invention to separately fabricate the parts and subsequently assemble them together.

Upon viewing this or other descriptions of the invention and/or a reduction to practice thereof, those skilled in the art will recognize that many variations may be made of the embodiments of the invention viewed by them. Therefore, it is not intended that the breadth of the invention be limited to the specific embodiments illustrated and described. Rather, the breadth of the invention is to be determined by the appended claims and their equivalents.

What is claimed is:

1. A utility knife comprising a case and a multi-blade cartridge in the case, said cartridge having separate new and used blade compartments each for receiving blades in closely spaced parallel planes, an opening in the case through which blades in the cartridge can be extended from the case to en operative position and retracted from the operative position into the case, said new and used blade compartments lying one behind the other with respect to the opening, and a carrier disposed in the case for transporting the blades from the new blade compartment to the operative position and from the operative position to the used blade compartment.

2. A utility knife comprising a case having a front end and a multi-blade cartridge mounted in the case, said cartridge having separate new and used blade storage areas, one behind the other with respect to the front end, said storage areas each holding blades in parallel planes, a carrier movable in the ease for moving single blades from the new blade storage area to an operative position wherein the blade extends out of the case and from the operative position to the used blade storage area.

3. A utility knife as described in claim 2 wherein, a slot is disposed in the front end through which the blades are extended to the operative position.

4. A utility knife as described in claim 3 wherein the storage areas lie one behind the other with respect to the slot.

5. A utility knife as described in claim 4 wherein the new blade storage area lies nearer the slot.

6. A utility knife comprising a case and a multi-blade cartridge mounted in the case, said cartridge having separate new and used blade storage areas, each of the storage areas adapted to hold a plurality of blades, the new blades in the cartridge being disposed in parallel planes, a carrier movable in the case for moving single blades from the new blade storage area to an operative position wherein the blade extends out of the case and from the operative position to the used blade storage area.

7. A utility knife as described in claim 6 wherein each of the blades has cutting facilities at opposite ends, and said cartridge may be reversed in the case to enable both of the cutting facilities to be moved from the cartridge to an operative position.

8. A utility knife comprising an elongated case having front and back ends, a chamber in the case extending longitudinally therein, a blade cartridge mounted in the chamber and having a pair of compartments arranged longitudinally one behind the other with respect to the case, a plurality of new blades disposed in one of the compartments, an opening in the front end of the case, and a carrier mounted in the case for engaging blades one at a time from said one compartment and moving them to an operative position wherein the blades extend out of the case through the opening and for withdrawing the blades from the operative position and depositing them in the other compartment in the cartridge.

9. A utility knife as described in claim 8 wherein an actuator is mounted externally on the case for moving the carrier.

10. A utility knife as described in claim 8 wherein the blades are disposed in face-to-face relationship in said one compartment and are deposited in face-to-face relationship in the other compartment.

11. A utility knife as described in claim 8 wherein each blade has longitudinally spaced cutting facilities at each end thereof, said cartridge being longitudinally reversible in the chamber enabling each cutting facility of each blade to be placed in the operative position.

12. A utility knife as described in claim 8 wherein the blades to be moved to the operative position are disposed in the compartment nearer the front end of the case.

13. A utility knife as described in claim 12 wherein the other compartment is for receiving used blades.

14. A utility knife as described in claim 12 wherein the carrier can move each blade from the compartment nearer the front end to the operative position to a stored position within the case, and through the front compartment to the other compartment.

15. A utility knife as described in claim 8 wherein a longitudinally extending track is provided in the cartridge and supports the carrier.

16. A utility knife as described in claim 8 wherein the cartridge is removable from the chamber and may be mounted with either compartment nearer the front end of the case.

17. A utility knife as described in claim 16 wherein the blades to be used are disposed in the compartment nearer the front end of the case and the other compartment receives blades after they have been used.

18. A utility knife comprising a case having front and back ends, a pair of compartments in the case disposed longitudinally one in front of the other, a plurality of blades in the compartment nearer the front end each having a cutting edge nearer the front end of the case, a slot at the front end of the case through which the blades may extend one at a time to expose the cutting edge of a blade in an operative position, the other of the compartments sized to receive used blades, and a carrier mounted on the case for transporting the blades one at a time from the compartment nearer the front end of the case to the operative position extending out of the case through the slot and from the operative position into the other compartment.

19. A utility knife as defined in claim 18 wherein the blades are disposed side-by-side in the compartment nearer the front of the case, and an opening to the compartment nearer the front of the case and aligned with the slot in the case for enabling the blades in that compartment to be transported from that compartment to the operative position through said slot.

20. A utility knife as defined in claim 19 wherein the opening extends to the other compartment enabling the carrier to move the blades one at a time to said other compartment.

21. A utility knife as defined in claim 20 wherein the compartments and openings are disposed in a cartridge mounted in the case.

22. A utility knife as defined in claim 21 wherein the case has a chamber for receiving the cartridge.

23. A utility knife as defined in claim 22 wherein the cartridge may be reversed in the chamber so that the other compartment may be positioned nearer the front end of the case.

24. A method of presenting utility blades one at a time to the operational end of a utility knife comprising the steps of providing a cartridge having a blade compartment at each end connected by a passage and a supply of blades in one compartment in parallel planes and adjacent one another and wit each blade having a cutting facility at each of its opposite ends, sequentially sliding the blades from one compartment so that one end of each blade is in the operative position and when used withdrawing the blade through the passage into the other compartment, reversing the cartridge in the knife when all the cutting facilities at one end of all the blades are used to position the other cutting facilities of the blades adjacent the operational end of the knife, and bringing said other cutting facilities one at a time into the operative position until both cutting edges of each of the blades are used.

25. A method as described in claim 24 wherein the blades are arranged immediately adjacent one another in the compartments, and the blades are moved by sliding tern one at a time to the operative position.

26. A method as described in claim 24 including providing a carrier to move the blades one at a time from one position to another.

27. A method of presenting utility blades one at a time to the operational end of a utility knife comprising the steps of providing an elongated cartridge having a pair of blade compartments one at each end thereof, providing unused utility blades in one compartment with each blade having a cutting edge at opposite ends thereof and enclosed in said compartment without the cutting edges being exposed, placing the cartridge in a case of a utility knife with said one compartment adjacent the operative end of the knife, and the other compartment at a location remote from the operative end, moving the blades one at a time from the one compartment so that one cutting edge extends out of the case in the operative position and thereafter moving the used blade into the other compartment, reversing the cartridge in the case so that said other compartment is adjacent the operative end of the case when the one cutting edge of each of the blades of said one compartment are used so that the unused cutting edge of each blade is disposed adjacent the operative end of the case, and moving the blades one at a time from the other compartment to the operative position to expose the other cutting edge of each blade.

28. A utility knife comprising an elongated case having a chamber and an operative end with an opening at that end communicating with the chamber, said opening for permitting an end of a utility blade to extend from the chamber to an operative position, an elongated blade cartridge disposed in the chamber extending in a direction generally parallel to the direction of elongation of the case, said cartridge having first and second compartments each for holding a plurality of utility blades in stacked fact-to-face relationship and longitudinally aligned with one another and with the longitudinal direction of the cartridge, a stack of utility blades disposed in face-to-face relationship in the compartment positioned nearer the operative end of the case with each blade having cutting edges at opposite ends, a passage in the cartridge extending adjacent to and open to the compartments and aligned with the opening in the operative end of the case for enabling one blade at a time to move from the compartment nearer to the operative end to an operating position extending out the opening and from that position back toward that compartment and to the other compartment, a spring engaging the stack of blades in the compartment near the operative end of the case and urging the first blade in the stack into the passage, a carrier movable longitudinally in the cartridge along the passage and including a pusher for engaging the first blade in the stack for moving it from the compartment to the operative position and back to the other compartment, and an actuator movable longitudinally on the case and attached to the carrier for moving it along the path.

29. A utility knife as described in claim 28 wherein a latch is operatively connected to the actuator for holding the carrier with its blade in selected operative and inoperative positions.

30. A utility knife as described in claim 28 wherein a spring is disposed in the cartridge for biasing blades in said other compartment toward the passage, and a second spring member in the other compartment for pushing the blades out of the passage to enable the carrier to deliver a blade from the one compartment to the other.

31. A utility knife as described in claim 28 wherein the carrier is movable out of the chamber for enabling a cartridge to be removed from or inserted in the chamber.

32. A utility knife as described in claim 28 wherein the carrier has pushers for engaging each blade for moving the blades toward and away from the operative end of the case.

33. A utility knife as described in claim 32 wherein the blade has a port for receiving one of the pushers for engagement by the carrier.

34. A utility knife comprising a case and a chamber in the case, said case having an operative end, a blade cartridge in the chamber, said cartridge having a pair of compartments, one adjacent each end, and each compartment adapted to store a plurality of blades each having two cutting ends and with the blades in parallel planes, mounting guides in the case enabling the cartridge to be selectively positioned in the chamber with either compartment adjacent the operative end, and an actuator means for engaging blades one at a time in the compartment adjacent the operative end extending them out the ease at the operative end.

35. A knife and blade cartridge combination comprising a handle having an interior chamber and a slot at one end for allowing blades to extend out of the handle, a reversible blade cartridge disposed in the chamber having a pair of ends, a pair of compartments in the cartridge for receiving blades, one compartment adjacent each end of the cartridge, said cartridge having a passageway at each end for enabling blades in each compartment to extend out of either of the compartments and through the slot one at a time from the compartment disposed closer to the slot, and an additional blade passageway in the cartridge connecting the two compartments for enabling a blade in the compartment closer to slot to be transferred to the other compartment.

36. A knife and blade cartridge as described in claim 35 wherein a carrier is movably mounted in the chamber and extends into the cartridge for moving blades one at a time from the compartment closer to the slot and extend it out of the slot and for thereafter moving the blade to the other compartment.

37. A knife and blade cartridge as described in claim 35 wherein a plurality of blades is initially contained in the compartment nearer the slot and moved one at a time to the other compartment after each is worn at the end extended through the slot.

38. A knife and blade cartridge as described in claim 37 wherein the chamber enables the cartridge to be reversed for moving the compartment with the worn blades nearer the slot.

39. A knife and blade cartridge as described in claim 38 wherein a carrier is movably mounted in the chamber and extends into the cartridge for moving blades one at a time from the compartment closer to the slot and extend it out of the slot and for thereafter moving the blade to the other compartment.

40. A knife and blade cartridge combination comprising a handle having an interior chamber and a slot at one end for allowing blades to extend out of the handle, a reversible blade cartridge disposed in the chamber having a pair of ends, and a pair of compartments in the cartridge, each for receiving multiple blades in parallel planes, one compartment adjacent each end of the cartridge, said cartridge having a passageway at each end for enabling blades in each compartment to extend out of either of the compartments and through the slot one at a time from the compartment disposed closer to the slot.

41. A knife and blade cartridge as described in claim 40 wherein blades having opposed cutting facilities at two corners are mounted face-to-face in the compartment nearer the slot.

42. A knife and blade cartridge as described in claim 41 wherein one corner of each blade in sequence is extended through the slot and when worn the blade is conveyed to the other compartment.

43. A utility knife comprising a case having an interior chamber for receiving a blade cartridge and having an opening through which a blade can project from the case to an operative position, a cartridge having a pair of compartments each capable of holding a plurality of blades in face-to-face relationship, said cartridge being reversible in the chamber so that one and then the other of said compartments is disposed adjacent the opening in the case, and a carrier mounted in the case for sequentially moving the blades in the one compartment to an operative position wherein a blade extends out the opening and thereafter for withdrawing that blade into the cartridge and depositing it in the other compartment, and when the cartridge is reversed in the chamber for sequentially moving the blades in said other compartment to an operative position wherein it extends out the opening and thereafter for withdrawing that blade into the cartridge and depositing it in the said one compartment.

44. A utility knife as described in claim 43 wherein the case is handle-shaped.

45. A utility knife as described in claim 44 wherein the opening is in an end of the case and the compartment from which a blade is to be moved to an operative position is disposed adjacent the said one end of the case.

46. A utility knife as described in claim 43 wherein blades are disposed in each compartment, said blades each having cutting edges at each end that are positioned to alternatively move into the operative position when the one and the other compartment are positioned adjacent the opening.

47. A utility knife as described in claim 43 wherein the cartridge when new has all he blades disposed in one compartment and when all the blades in that compartment are transferred to the other compartment the cartridge is reversible in the chamber.

* * * * *